US007850535B2

(12) United States Patent
Noble et al.

(10) Patent No.: US 7,850,535 B2
(45) Date of Patent: Dec. 14, 2010

(54) TETHERED BALL GAME HAVING TARGETS AND INDICATORS

(76) Inventors: Thomas J. Noble, 1428 W. 222nd St., Torrance, CA (US) 90501; David Rabb, 3610 May St., Los Angeles, CA (US) 90066

( * ) Notice: Subject to any disclaimer, the term of this patent is extended or adjusted under 35 U.S.C. 154(b) by 1180 days.

(21) Appl. No.: 11/474,892

(22) Filed: Jun. 26, 2006

(65) Prior Publication Data

US 2008/0015058 A1 Jan. 17, 2008

(51) Int. Cl.
*A63B 69/36* (2006.01)

(52) U.S. Cl. ..... 473/140; 473/143; 467/7; 467/49; 273/331

(58) Field of Classification Search ..... 473/139–140, 473/143, 145–149, 415, 422, 424, 429–430, 473/222–226; 273/329–331, 333; 463/7, 463/49

See application file for complete search history.

(56) References Cited

U.S. PATENT DOCUMENTS

| | | | | |
|---|---|---|---|---|
| 3,580,575 | A | 5/1971 | Speeth | |
| 4,003,572 | A * | 1/1977 | Harvey | 473/429 |
| 4,270,757 | A | 6/1981 | Ligon | |
| 4,576,379 | A * | 3/1986 | Juhasz | 473/430 |
| 4,577,865 | A | 3/1986 | Shishido | |
| 4,595,200 | A | 6/1986 | Shishido | |
| 4,748,366 | A | 5/1988 | Taylor | |
| 4,761,004 | A | 8/1988 | Hargabus | |
| 4,824,107 | A | 4/1989 | French | |
| 5,018,729 | A | 5/1991 | Wilkerson | |
| 5,060,946 | A * | 10/1991 | Taylor | 473/429 |
| 5,236,383 | A | 8/1993 | Connelly | |
| 5,260,512 | A | 11/1993 | Chomette | |
| 5,375,839 | A | 12/1994 | Pagani | |
| 5,605,336 | A | 2/1997 | Gaoiran | |
| 5,611,540 | A | 3/1997 | Williams | |
| 5,810,685 | A | 9/1998 | Willner | |
| 5,836,836 | A * | 11/1998 | Grimes | 473/427 |
| 5,857,939 | A | 1/1999 | Kaufman | |
| 5,957,781 | A | 9/1999 | Kelly | |
| 6,544,099 | B2 | 4/2003 | Shafik | |
| 6,645,094 | B2 * | 11/2003 | Obidiegwu | 473/461 |
| 2004/0162170 | A1 | 8/2004 | Ng | |
| 2004/0254036 | A1 | 12/2004 | Smith | |

* cited by examiner

*Primary Examiner*—Peter DungBa Vo
*Assistant Examiner*—Alex F. R. P. Rada, II

(57) ABSTRACT

The embodiments may relate to games or sports using tangible projectiles. A tethered ball game embodiment may include a play ball and a tether that may be connected to the play ball and a sensor head assembly. The tether may be elastic. The sensor head assembly may have a force sensor to determine an impact power imparted to the play ball, a spin sensor to determine a rotational value of the play ball, a travel path sensor to determine a path of travel of the play ball, and a play ball strike sensor to determine a strike to the play ball. The tethered ball game also includes a target device and a player feedback system having lights and audio feedback, all controlled by a controls system.

16 Claims, 15 Drawing Sheets

| Options [Hardware] | Primary Benefit | Applications |
|---|---|---|
| Force Sensor [Piezo Element] | Lowest cost Product Implementation<br>Very Simple - only basic functions | Product Line's baseline configuration. |
| Ambient Sound Sensor [Microphone] | Environmental sound level detection | Alarm Signal - Relative Sound Level Trigger |
| Play Ball Strike detector [Bandpass filter] | Know when Play Ball is hit to react interact better and faster. | Provides Rhythm Detection; Syncs MIDI playback.<br>Compare to Force signal timing |
| Number of Gaming Targets (5, 8, 16 or more) [Piezo, Membrane Switch, Optical or Proximity Sensors] | Personal preference for challenge range.<br>Flexible target layouts for different environments; Room constraints or expansion | Bigger Room. Commercial application<br>Provide audible feedback to player<br>Piezo audibly responds to successful hit. |
| Number of Directions (5, 8, or 16) (Path sensors) [Piezo, Membrane Switch, Optical or Proximity Sensors] | 5 elements will divide 360 degrees into 10 slices<br>8 elements will divide 360 degrees into 16 slices<br>16 elements will divide 360 degrees into 32 slices<br>Firmware may group several adjacent elements to function as a single element | Team Zone divisions; younger player handicap<br><br>Typically matched with adjacent Target quantity. |
| Ethernet Communication Port [RJ-45 Connector and Integrated Circuit] | Computer based operations; save personal performance data, specific game configurations and adding new games. | Expands available features and personalization of product |
| Power Over Ethernet (POE) [RJ-45 Connector and Integrated Circuit] | Standardized Power Source, a single interface connection interface to the world. | Commercial and modern residential Ethernet |
| Spin Detector [DC motor, optical wheel or magnetic pole on shaft] | Additional dimension in play ball interaction. | Some Games<br>Build new skillset |

FIG. 20A

| Options [Hardware] | Primary Benefit | Applications |
|---|---|---|
| Battery Power [Battery, Connector and Integrated Circuit] | Portable Operation | Outdoors or other power source unavailable |
| MIDI Sounds [1MB MIDI ROM] [Song Library] | May be a world wide Standard, has smaller Music Files so significantly less memory required | All operations may be enhanced with background melodies; timing of melody be controlled with Punch or Force Detection |
| LED, LCD or E-Ink Display | Display the Score when ambient noise is high. | Noisy Environments, Deaf player |
| Audio Speaker(s) Stereo | Playtime Audio Stimulation | More thrilling interaction with sound. |
| Audio Line - Output [3.5MM Jack & buffer chip] | External Amp/Speakers for more volume and/or enhanced sounds. | More thrilling for more people; recording events |
| Audio FM Transmitter | Wireless Audio to Home or Portable Stereo for enhanced sound | Remote location or tournament portable |
| Wireless Communication [external computer with Bluetooth ability] | Wireless Computer based operations; save personal performance data, specific game configurations and adding new games. | Expands available features and personalization of product with wireless advantages. |
| Gaming and Exercise Management Software [External Computer] | Maximum flexibility, Maintain Scores, New Game Downloads, Customize Reaction to each sensor provided | Personal fitness tracking records and logs |
| Game Club Account [External Computer with WWW access] | Access online library of Games, MIDI Sounds and other Updates. See how others are doing with same games. Group based games. | Discount on materials, free games, promotional and clubs. |
| Player's Feet Position Detector [Sensor Floor Mat] | Enhanced gaming abilities more challenging | Advanced gaming abilities; designate and determine the player's feet positioned on mat |

FIG. 20B

TETHERED BALL GAME HAVING TARGETS AND INDICATORS

COPYRIGHT AND TRADEMARK NOTICE

A portion of the disclosure of this patent document may contain material that is subject to copyright or trademark protection. The copyright or trademark owner has no objection to the facsimile reproduction by anyone of the patent document or the patent disclosure, as it appears in the Patent and Trademark Office patent file or records, but otherwise reserves all copyright and trademark rights whatsoever.

BACKGROUND

1. Field of Endeavor

The embodiments may include games or sports using tangible projectiles. More particularly, an embodiment may include an apparatus having a projectile secured by a tether to a point of aim target device, where the target device may be associated with an indicator to provide the player with game feedback information.

2. Background Information

Traditional sports activities typically require a high level of physical involvement in less than safe environments. A result is that those with physical limitations are largely excluded. In addition, since each sport generally is directed towards people of a particular age group, no one sports activity appears to have a common element for people of all ages.

For those games using balls, physical interaction is fast paced, stressful, and, to many, threatening. One of the more challenging and stressful aspect may be simply chasing after the ball when a foul occurs. In addition, once the ball is struck, the movement of the ball and thus the experience is relatively predictable and feedback of play is nonexistent or, at best, incomplete. What is needed is an apparatus and method to overcome these and other shortcomings.

SUMMARY

The embodiments may relate to games or sports using tangible projectiles. A tethered ball game embodiment may include a play ball and a tether that may be connected to the play ball and a sensor head assembly. The tether may be elastic. The sensor head assembly may have a force sensor to determine an impact power imparted to the play ball, a spin sensor to determine a rotational value of the play ball, a travel path sensor to determine a path of travel of the play ball, and a play ball strike sensor to determine a strike to the play ball. The tethered ball game also includes a target device and a player feedback system having lights and audio feedback, all controlled by a controls system.

BRIEF DESCRIPTION OF THE DRAWINGS

FIG. 20A is a table summarizing game assembly 100 options; and

FIG. 20B is a continuation of the table of FIG. 20A summarizing game assembly 100 options.

DETAILED DESCRIPTION

Figure 1:
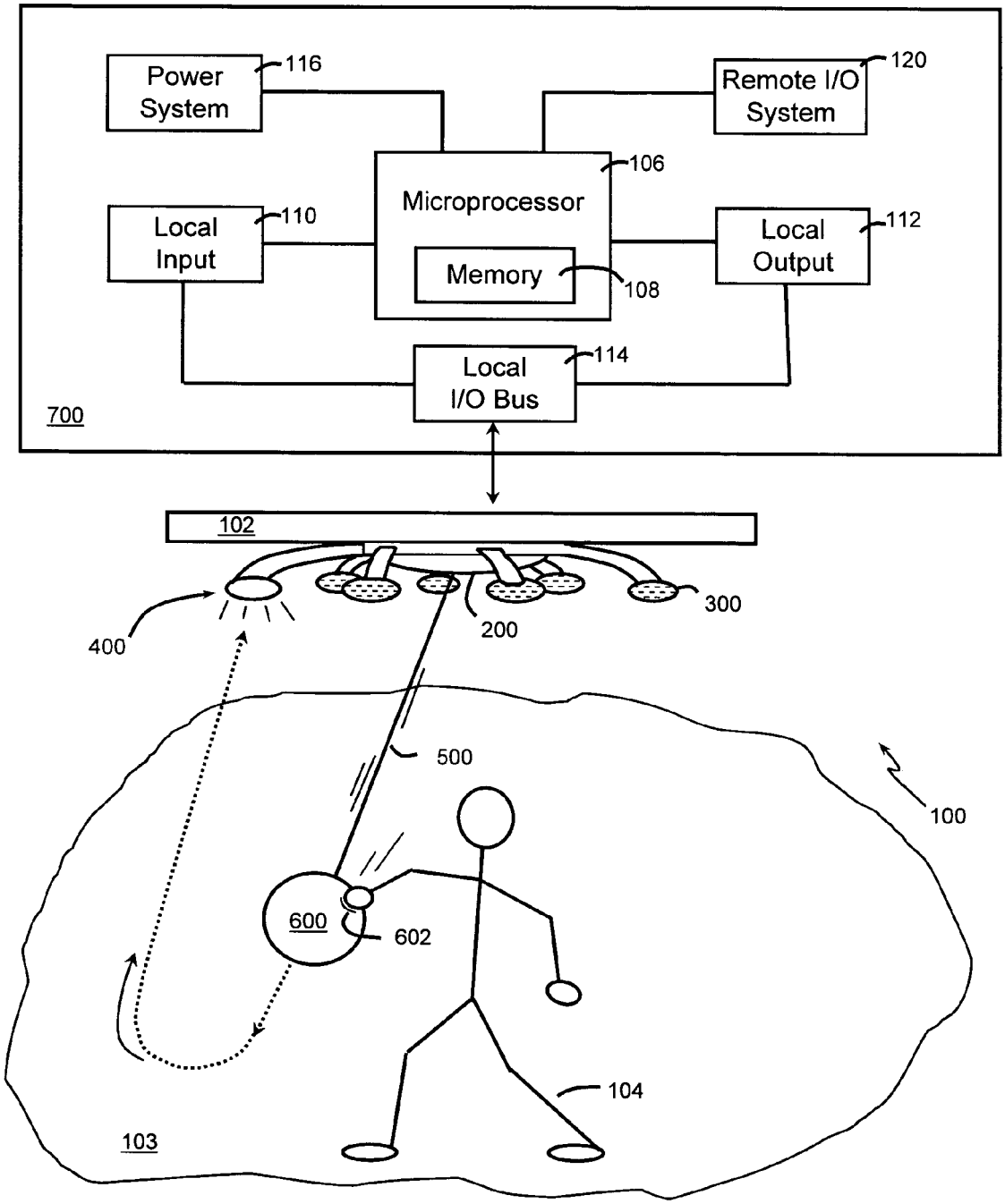
FIG. 1 is an elevated view of a game assembly 100.

FIG. 1 is an elevated view of a game assembly 100. Through hardware and software functionality, game assembly 100 may be customized to present a number of unique games guided by rules. In addition to enhancing exercise and play enjoyment, game performance data and scores further may be used in custom physical therapy regimes.

Included with game assembly 100 of FIG. 1 may be a sensor head assembly 200, a target device 300, a player feedback system 400, a tether 500, a play ball 600, and a controls system 700. Game assembly 100 may be secured to a mounting platform 102, such as a ceiling of a home. Alternatively, mounting platform 102 may be a tree or other stable structure adapted to provide an overhang. Below mounting platform 102 may be space 103. Space 103 may be an area that permits a player 104 to flex and play game assembly 100.

Controls system 700 may include a microprocessor 106 having a memory 108, a local input 110, a local output 112, and a local in/out (I/O) bus 114. Local input 110 may receive game signals through local I/O bus 114 and transmit them to microprocessor 106. Microprocessor 106 may process these signals and transmit the processed signals back to a player 104 through local output 112 and local I/O bus 114. Controls system 700 additionally may include a power system 116 to energize the system and a remote I/O system 120 to communicate with remote systems outside of control system 700 or away from game assembly 100, such as those systems connected to the Internet.

In operation, player 104 may strike play ball 600 at a location 602 on play ball 600. In response, play ball 600 may move. From the movement of play ball 600, sensor head assembly 200 may determine the impact power with which play ball 600 is struck, the path of travel of play ball 600, and the spin of play ball 600. Moreover, play ball 600 subsequently may strike target device 300 to produce an audio/ visual feedback through player feedback system 400, the electronics of which may be controlled by controls system 700.

I. Sensor Head Assembly 200

Figure 2:
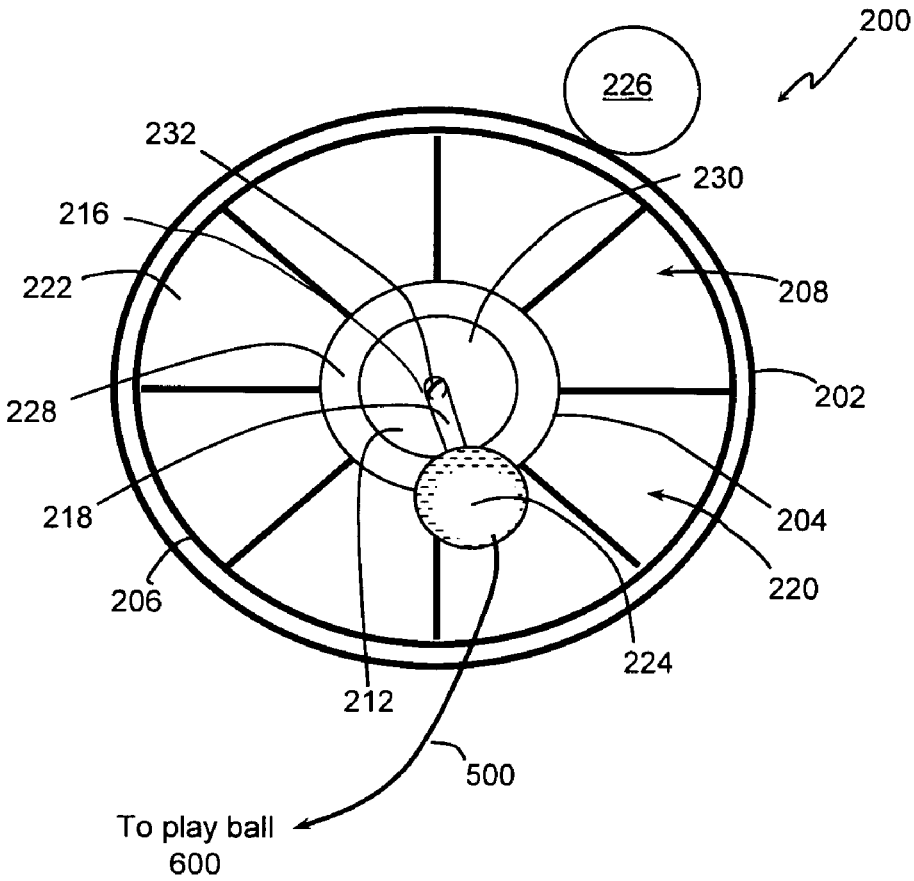
FIG. 2 is a bottom view of sensor head assembly 200.
Figure 3:
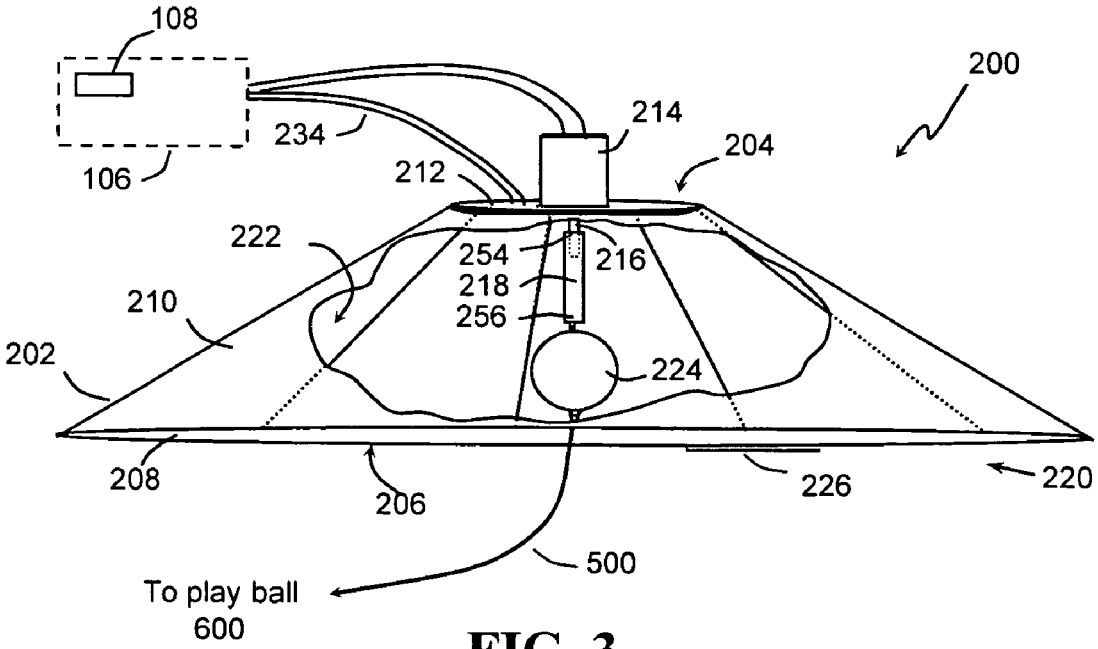
FIG. 3 is a side-elevated view of sensor head assembly 200.

FIG. 2 is a bottom view of sensor head assembly 200 and FIG. 3 is a side-elevated view of sensor head assembly 200. To monitor the general activities of play ball 600, such as impact power, travel path, and spin, sensor head assembly 200 may employ several different sensors. For example, piezoelectric (piezo) sensing elements may be utilized to determine force, membrane switches sensing elements may be utilized to determine an angle direction in which play ball 600 may move, and a direct current (DC) motor may be used to determine spin. Additionally, an audio sensor may be utilized to detect a physical strike to play ball 600. These will be explained in more detail below.

Importantly, in one embodiment, neither the force sensor, nor travel path sensor, nor spin sensor of head assembly 200 are in direct contact with play ball 600 nor contained within play ball 600. This may work to minimize ware on these sensing elements and may allow for a lighter play ball 600 with less potential to cause damage to player 104 should play ball 600 strike player 104 unexpectedly.

In one embodiment, sensor head assembly 200 may include a cone 202 (best seen in FIG. 3) having a narrow opening 204 at an upper end, a wide opening 206 at a lower end, an interior 208, and an exterior 210. Sensor head assembly 200 may also include a force sensor 212 attached to narrow opening 204 and a spin sensor 214 attached to both force sensor 212 and tether 500, where the attachment to tether 500 may be through a spin sensor shaft (shaft 216) and a coupler 218. Additionally, sensor head assembly 200 may include a travel path sensor 220, having direction detectors 222 attached to interior 208 of cone 202 and having a clapper 224 attached between coupler 218 and tether 500. Further, sensor head assembly 200 may include a play ball strike sensor 226 to detect a physical strike to play ball 600. Force sensor 212, spin sensor 214, travel path sensor 220, and play ball strike sensor 226 of sensor head assembly 200 now will be discussed in more detail.

A. Force Sensor 212

Force sensor 212 may aid in determining the impact power with which play ball 600 is struck. In one embodiment, a piezoelectric transducer may be used as part of force sensor 212. As best seen in FIG. 2, force sensor 212 may include a metal panel 228 and a ceramic plate 230 attached to metal panel 228. Both metal panel 228 and ceramic plate 230 may have material removed to define a hole 232, where hole 232 may allow shaft 216 (FIG. 3) to be disposed through hole 232.

Force sensor 212 may be secured to cone 202 by attaching metal panel 228 to cone 202. Metal panel 228 may have a larger diameter than a diameter of narrow opening 204 of cone 202 to prevent metal panel 228 from falling through narrow opening 204. In one embodiment, metal panel 228 of force sensor 212 is a 1.5-inch circular piezoelectric sensing element.

To secure metal panel 228 in place, a bead of adhesive may be placed between metal panel 228 and cone exterior 210. Metal panel 228 may be made from a strong metal, such as brass and ceramic plate 230 may be made from a permanently-polarized material such as quartz ($SiO_2$) or barium titanate ($BaTiO_3$). Force sensor 212 may be manufactured from the piezo element with lead wire Model No. FML-41T-1.0A1-L, manufactured by Ningbo East Electronics Limited of Jiangdong Science Garden, NingBo 315040, P. R. China (http://www.east-mingtao.com/p11_1.htm).

When configured as a piezoelectric transducer, an active element in force sensor 212 may be the permanently polarized material of ceramic plate 230. When player 104 (FIG. 1) strikes play ball 600, play ball 600 may give a tug onto tether 500. In turn, tether 500 may pull on spin sensor 214 that, in turn, may push on ceramic plate 230. Because of this imposed mechanical push force, ceramic plate 230 may change dimensions and produce an electric field signal that corresponds to the mechanical force. A set of force sensor wires 234 of force sensor 212 may transmit these piezoelectric effect electric field signals to microprocessor 106 of controls system 700 (FIG. 1). Microprocessor 106 may convert these signals into digital waveforms and provide interpretation for determination of future activity for game assembly 100.

Force sensor 212 also may be referred to as a tug sensor because of the tug-like force tether 500 may impart on force sensor 212. In one embodiment, force or tug sensor 212 may generate bi-level electronic voltage impulses corresponding to the flexing direction of a piezo element, here ceramic plate 230 (FIG. 2). As a piezoelectric transducer, the voltage generated may be proportional to the dynamic motion of ceramic plate 230 as it relates to play ball 600 pulling on ceramic plate 230.

Figure 16:
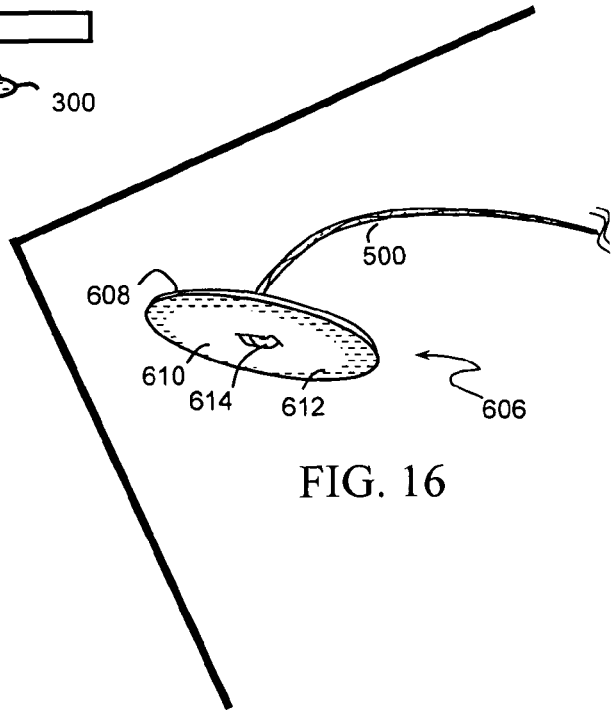
FIG. 16 illustrates a ball-to-cord adaptor 606.

To provide an appropriate sensitivity range for force sensor 212, a signal level of force sensor 212 may be adjustable through a sensitivity adjustment 236 (shown in FIG. 16). The operation of sensitivity adjustment 236 may be performed automatically by microprocessor 106. In other words, games automatically may set their own levels. Moreover, player 104 may perform operation of sensitivity adjustment 236 manually.

Figure 4:
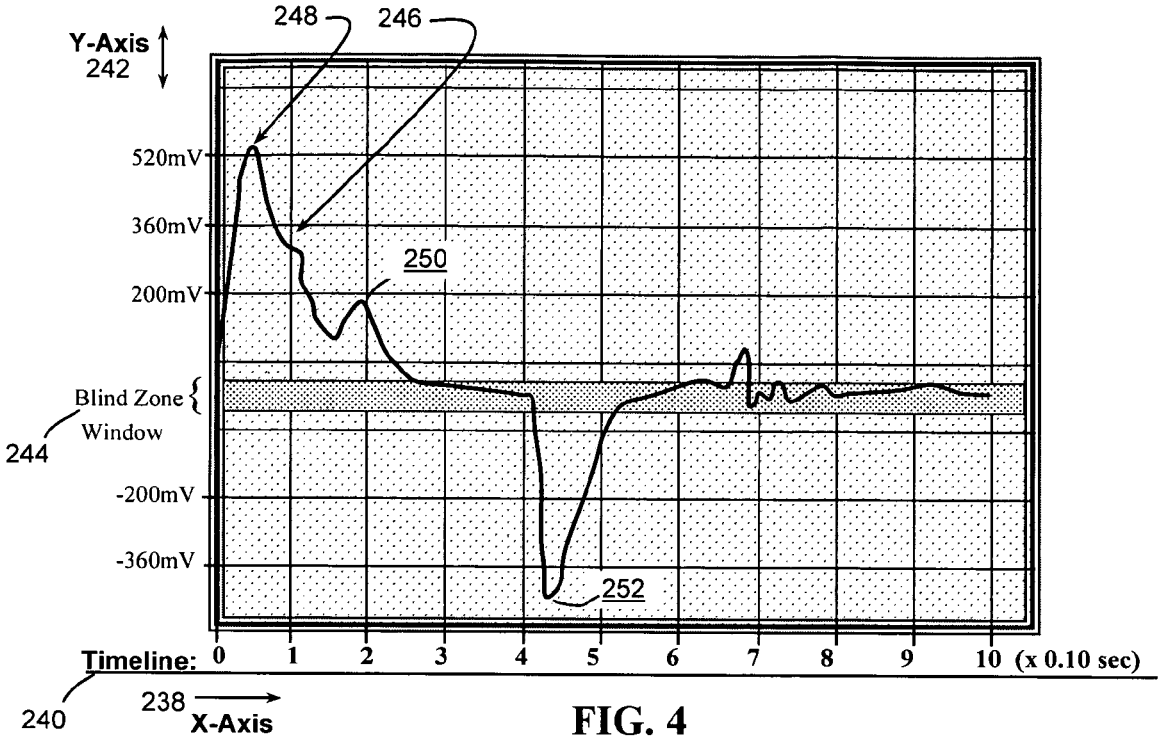
FIG. 4 is a graph of an example force sensor voltage waveform signature utilized to explain sensitivity adjustment 236 (FIG. 16)

FIG. 4 is a graph of an example force sensor voltage waveform signature utilized to explain sensitivity adjustment 236 (FIG. 16). An X-axis 238 is represented by a timeline 240 divided into tenths of a second and a Y-axis 242 is divided into indicated positive and negative millivolt values. It may be convenient to set sensitivity adjustment 236 so that ambient noise level registers may only inside the boundary of a bipolar blind zone window. Thus, a blind zone window 244 may be defined to be positioned equally above and below a zero millivolt level on Y-axis 242 and may be used as a default "play ball resting state" level.

Input signals may appear as a waveform signal, such as waveform signal 246 of FIG. 4. When waveform signal 246 resides within blind zone window 244, this may inform the operator of signal adjustment 236 that no force is being imparted by play ball 600 onto force sensor 212. In such a case, waveform signal 246 may be representative of ambient noise more than anything else. When waveform signal 246 resides outside of blind zone window 244, this may inform the operator of signal adjustment 236 that a force is being imparted by play ball 600 onto force sensor 212. In other words, someone or force may have hit play ball 600 or that ambient sound levels are of sufficient amplitude to exceed the threshold established by the signal adjustment 236.

Sensitivity adjustment 236 may automatically adjust a width of a blind zone window 244. In one embodiment, an upper boundary 245 of blind zone window 244 may be adjusted higher into the positive millivolts and a lower boundary 247 may be adjusted lower into the negative millivolts through sensitivity adjustment 236. In addition, both upper boundary 245 and lower boundary 247 may be restricted from being adjusted towards the zero millivolt level beyond a detected average ambient noise on Y-axis 242. Moreover, upper boundary 245 of blind zone window 244 may be adjusted higher in a bipolar millivolt level through sensitivity adjustment 236 and where lower boundary 247 may be restricted from being adjusted below an ambient driven millivolt level.

Complementary by differential relationship, a zero millivolts value preferably may be in the middle of blind zone window 244 or may be half way between the two bipolar positive and negative levels (ambient noise level). A reason for this is that a minimum sensitivity threshold is required to establish a "play ball resting state" for microprocessor 106 to determine play ball 600 activities more accurately and appropriately respond to play ball 600 activities. Experiments have shown that when a boundary 245, 247 of blind zone window 244 was adjusted below a level relative to ambient noise level, some games responded incorrectly and others became erratic in their behavior. A reason for this may be that ambient noises are often a cause to decrease the sensitivity of blind zone window 244.

During the activities of game assembly 100, it may be very important for game assembly 100 to interact with player 104. The significance of the "play ball resting state" provides for changes in tempo during games and, just as important, periods of inactivity would not be clearly represented. Without the blind zone window minimum, microprocessor 106 may detect and respond to the normal side-to-side lobbing of play ball 600 prior to the resting state as if side lobbing of play ball 600 was in fact a player 104 initiated striking activity. In addition, ambient noises of sufficient amplitude may cause false processing to occur.

A waveform signal 246 seen in FIG. 4 is an example resulting waveform of a single strike at play ball 600, using a four foot long, 0.55 inch diameter elastic tether 500 and a very light, 33 gram, 10 inch diameter play ball 600.

Waveform signal 246 was produced in experimentation as follows. A single strike to play ball 600 starts waveform signal 246 at timeline 240 position 0 decaseconds. A peak 248 in waveform signal 246 occurs about half way between X-axis 238 positions 0 decaseconds and 1 decasecond at approximately ½ decaseconds or 50 milliseconds (mS). This peak 248 corresponds to play ball 600 reaching a tethered stretch limit of tether 500. Then, as play ball 600 returns due to retraction in any elastic properties of tether 500, the voltage signal from ceramic plate 230 (FIG. 2) decays.

An operator of sensitivity adjustment 236 next may see a notable rise in voltage (100 mV) at peak 250 near position 2 decaseconds on X-axis 238. In this case, as play ball 600 tugs lightly on tether 500, some ball lobbing of play ball 600 is seen in waveform signal 246 as peak 250. Since such ball lobbing is not a strike by another person or the result of play ball 600 hitting another object (such as a target device 300 (FIG. 2)), microprocessor 106 may not register peak 250 as a strike.

In general, a piezoelectric transducer generates voltage only on a flexing activity. The large negative going peak 252 of FIG. 4, just past 4 decaseconds on X-axis 238, may represent the ceramic plate 230 being restored to an original shape. As play ball 600 passes from 2 decaseconds to 4 decaseconds, a natural voltage decay may take the waveform signal 246 into blind zone window 244. This natural voltage decay may be piezoelectric transducer application related.

As noted above, when waveform signal 246 resides in blind zone window 244, this informs the operator of signal adjustment 236 that no force is being imparted by play ball 600 onto force sensor 212. By raising the height of blind zone window 244, an operator may provide an appropriate sensitivity range for force sensor 212. This minimum blind zone window adjustment may make a game more suitable for less active/aggressive players or younger children that are unable to move the play ball with farther excursions. In contrast, a larger blind zone window 244 setting (there also is a limit to how high blind zone window 244 may be positioned for the same type of reason) requires the player to exert a higher level of force on the play ball to exit blind zone window 244.

Newton's first and second laws of motion confirms this: (i) any object in motion will stay in motion and that any object at rest will stay at rest unless acted on by an outside force; (ii) an object accelerates in the direction of the net force that acts on it and in the opposite direction from the mass itself. With this in mind, an appropriate sensitivity range for force sensor 212 (appropriate level) may be a level having enough difference to trigger a change-of-state taking into account (i) a player's striking force, anticipated style, and anticipated physical position for a known game, (ii) a weight of play ball 600 as applied against and with the kinetic energy of tether 500, (iii) an average ambient noise level, and (iv) aerodynamics of play ball 600, including air resistance due to the cross-sectional area of the surface of play ball 600.

Certain games may require player 104 to strike play ball 600 successively to match a rhythmic beat of game assembly 100 (Game Beats-Per-Minute (GBPM)). Alternatively, player 104 may strike play ball 600 to their own rhythm (Player Beats-Per-Minute (PBPM)). As discussed in more detail below, each change in PBPM rhythm may cause a different audio and/or visual signal.

Where a game requires player 104 to strike play ball 600 successively, sensor 212 may be utilized to translate successive striking of play ball 600 by player 104 into a beat rhythm. The players beat (beats per second) may be established at each end of play ball 600*s* peak travel extension with the "force signal." A beat for rhythm synchronism may be a moving average of the last three tugs imparted by play ball 600 onto tether 500 (play ball tugs) such that a single off-beat strike need not be a determining factor in lower game levels. In higher game levels, the moving average may be based on two play ball tugs.

B. Spin Sensor 214

Spin sensor 214 is best seen in FIG. 3. Timely spinning of play ball 600 by player 104 may be part of a game played on game assembly 100. To this end, spin sensor 214 may aid in determining both whether play ball 600 is spinning and in what direction (clockwise/counterclockwise) play ball 600 is spinning. A value for whether play ball 600 is spinning may be represented by a revolution-per-minute rotational spinning value (with zero representing no spinning) and a spinning direction value may have a value of one to represent clockwise and a value of negative one to represent counterclockwise. Experimentation has shown that spin durations as measured at spin sensor 214 may typically last an average periods of 0.7 seconds.

Knowing whether play ball 600 is spinning and in what direction may be important because some games may direct player 104 simultaneously to spin the play ball in a specific direction and cause play ball 600 to make contact with a game indicated target 300. Alternatively, a game may require player 104 to hit play ball 600 toward an indicated target 300 without spinning the play ball 600. Experiments have shown that this last skill is challenging and requires refined hand-to-eye coordination and timing skills to perform.

In another game, control system 700 may be programmed to react to (i) the spinning speed variation as slower to faster play ball 600 spinning, (ii) spinning in the correct direction, and (iii) to no spinning (as directed by the game). Such reaction may include changes in music or sound effect volume, changes in audible tone pitch, or playing a special sound effect, depending of the characteristics of the game. These may be basic attributes of any given game, mostly in the advanced stages. With timely and successful responses by player 104, game points may be awarded.

As noted above, spin sensor 214 (FIG. 3) may be attached to force sensor 212 and attached to tether 500 through spin sensor shaft 216 and coupler 218. When installed, a first coupler end 254 of coupler 218 may be attached to spin sensor shaft 216 and a second coupler end 256 of coupler 218 may be attached to a free end 502 of tether 500. Each coupler end 254 and 256 may be held in place through radial compression force imparted by coupler 218.

Coupler 218 may aid in quickly switching one play ball 600 for a different play ball 600. Preferably, coupler 218 may be inexpensive, reusable, slip resistant, and easy to remove and to reattach. In one embodiment, coupler 218 may be a one-inch length section of rubber tubing. A benefit of using rubber tubing is that pulling on the tubing (applying longitudinal tensile force to the rubber tubing) causes the tubing to elongate and tighten about spin sensor shaft 216 and tether 500.

In another embodiment, coupler 218 may include a Chinese finger trap. Due to the particular crisscross stitching of a Chinese finger trap tubular shape, more axial force causes the Chinese finger trap to grip tighter, allowing for higher torque and load (pull) capabilities than other sleeves. In such an embodiment, a Chinese finger trap coupler 218 may grip tighter as spin sensor shaft 216 and tether 500 pull in opposite directions from within the crisscross stitching of the Chinese finger trap. Alternatively, coupler 218 may be a swivel that permits tether 500 to rotate about its own axis. In a further embodiment, coupler 218 may include a section of heat shrinkable insulation sleeving.

Figure 5:
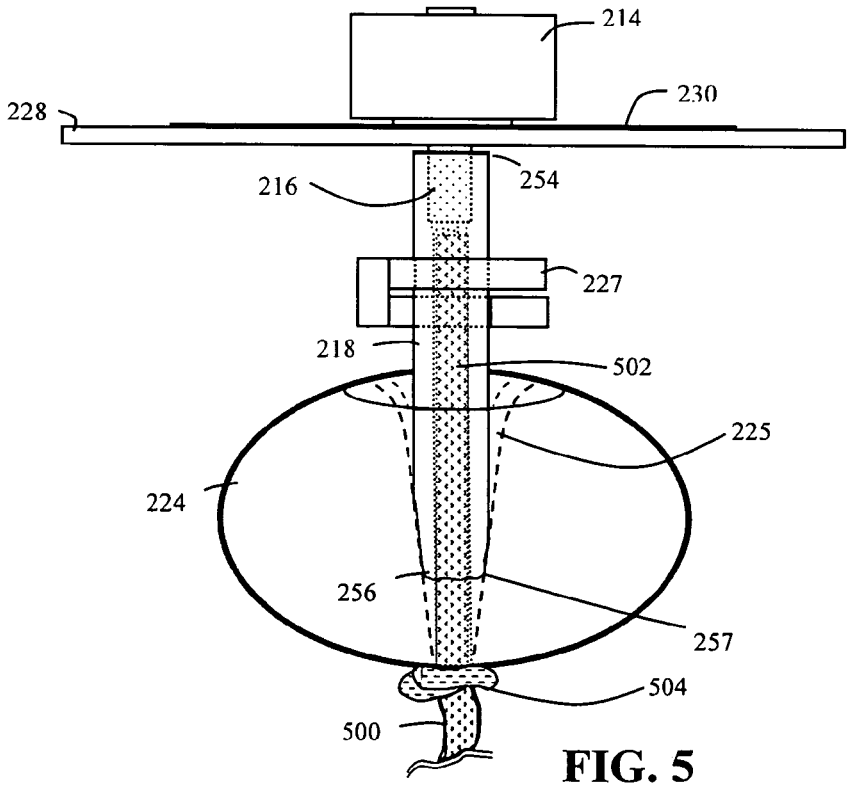
FIG. 5 is a detailed view of an assembly between tether 500 and spin sensor 214.

FIG. 5 is a detailed view of an assembly between tether 500 and spin sensor 214. First, a knot 504 may be tied in tether to define free end 502 of tether 500. Free end 502 then may be inserted through a hole 225 formed in clapper 224. Hole 225 may be tapered and have rounded edges.

Second coupler end 256 may be pushed about free end 502 so that free end 502 of tether 500 is positioned within coupler 218. First coupler end 254 may then be pushed around shaft 216. A clamp 227 may then be secured about coupler 218 and free end 502.

In operation, coupler 218 may allow tether 500 to breakaway from sensor head assembly 200 should someone sit on play ball 600, for example. Measurably, coupler 218 may separate on experiencing three to five pounds of force beyond the elastic extension of 100% of the normal length of tether 500. However, it is important that coupler 218 securely hold tether 500 to spin sensor shaft 216 against any anticipated game play compression and torque forces imparted into play ball 600. It is important, therefore, that the radially inward compression forces between first coupler end 254 and spin sensor shaft 216 and second coupler end 256 and tether 500 be not less than 5 lbs. and not be greater than 60 lbs.

For safety, it may be preferable that a breakaway of tether 500 may not bring down with it any hard parts, caps, pins, or ceiling. Here, coupler 218 may be attached between clapper 224 and a free end of tether 500. It is important in this embodiment, therefore, that radially inward compression forces between coupler 218 and tether 500 be not less than 25 lbs. and not be greater than 8 lbs.

In another embodiment, tether 500 may be attached directly to shaft 216 and coupler 218 may be eliminated to allow the more aggressive players freedom to hit play ball 600 with a desired force. In general, coupler 218 may be an optional feature to this embodiment and may be an attractive option for households with younger children who are more likely to sit on play ball 600.

As play ball 600 spins, tether 500 and coupler 218 may twist and cause spin sensor shaft 216 (FIG. 5) to spin in the same direction. As spin sensor shaft 216 turns, this rotating mechanical force may be converted to an electrical force by components of spin sensor 214. Preferably, the generated electrical force may have a voltage polarity and amplitude that identify whether play ball 600 is spinning and in what direction (clockwise/counterclockwise) play ball 600 is spinning. Faster spinning of play ball 600 may generate a proportionally higher level of DC voltage.

In one embodiment, spin sensor 214 may include a direct current (DC) voltage generator/motor, a tachometer, or similarly functioning spinning type device to convert rotational mechanical force to a desired electrical force. Significant sensor voltage levels for the DC motor may be no less than 20 milliVolts (mV). A voltage conditioning circuit may be used to amplify or offset the spin sensor signal voltage and to adjust for signal polarities before delivery to microprocessor 106 (FIG. 1). These significant sensor voltage levels may have durations of no less than 160 milliseconds (mS). These minimum voltage level and duration requirements may work to reduce false triggering signals within microprocessor 106.

To avoid interfering with movement of play ball 600, the DC motor of spin sensor 214 may have very low drag characteristics. For example, the rotational friction resistance of spin sensor shaft 216 may be such that no more than two twists of tether 500 may be needed to move shaft 216 in the same direction as tether 500. Here, a detection range may be resolved to not less than three, starting with a minimum of two revolutions per second (rps). In experimentation, a four-foot length of 0.055-inch diameter round cord for tether 500 and a three ounce, ten inch diameter vinyl ball were used to determine that the rotational friction resistance of spin sensor shaft 216 may not be greater than a torque 2.5 to 3 inch-grams.

The same direct current (DC) voltage generator utilized to determine the spin of play also may be used as a motor to impart spin into play ball 600. This particularly may be applicable to an idle (standby) condition where play ball 600 is idle to entice a player 104 back to a game by spinning play ball 600. Imparting spin into play ball 600 additionally may serve to capture the attention of player 104 to begin, continue or finish a game in progress as well as serve to stimulate and interact with player 104 by spinning in game driven periods. For example, spin sensor 214 may spin play ball 600 clockwise at two revolutions per second whereas the game being played may require player 104 to spin play ball 600 counterclockwise as a way to prevent spin sensor 214 from detecting any spin movement in either direction. This imparted spin may be accompanied by a sound effect, such a signature sound for a particular game or a marketing promotional announcement. The tethered ball game of claim 9, where the spin sensor determines a valid rotational value of the play ball when the motor generates no less than 20 millivolts for duration sets of more than 160 milliseconds to reduce false triggering signals.

A game control may be configured to be connected through a network to download new and customized game configurations and to upload player game statistics. The game control may include a wireless gaming network interface. In addition, a gaming experience may be configured to be customized by a game user by the game user selecting personal options available in a modular nature of a game topology.

In another embodiment, spin sensor 214 may include a simple bearing assembly having an optical strobe disk to serve as a spin detector. The optical strobe disk may be mounted to a top of the integral shaft bearing. Integral shaft bearings may be used where the load on the bearing elements is not significant but economy in space and cost are the critical factors. In this embodiment, a bearing assembly shaft may form an inner race for holding a sleeve or for holding an outer race to eliminate the need for a separate shaft/spindle/stud to mount the strobe disk.

The optical strobe disk may be marked with a series of infrared light reflective and non-reflective stripes originating from the center of the disk in a series pattern such as "0011101010", where "1"=reflective and "0"=non-reflective. As the infrared emitter/detector (spin detector device) faces the disk pattern, a spinning pattern of reflected signals from the infrared emitter may be detected by the adjacent infrared detector and the rotation related pattern may be quickly resolved by microprocessor 106 to determine clockwise or counter clockwise rotation of play ball 600.

In another embodiment, spin sensor 214 may include a bearing assembly having an polarized magnet mounted to the top the integral shaft bearing with two Hall-Effect magnetic position sensors (such as Honeywell P/N# SS-19T) or standard magnetic proximity switches/Reed Switches mounted in close proximity to the magnet. The two devices may be mounted apart from each other on the same side of the bearing assembly radius so the magnet passes by and triggers each device independently as it spins with the bearing assembly. The sequence of signals generated may be interpreted by the rotation related pattern and may be quickly resolved by microprocessor 106 to determine clockwise or counter clockwise rotation of play ball 600. In this embodiment, signal amplification may not be required. In addition, the resulting signal may be considered digital with only a "1" or "0" voltage level present and provided to the microprocessor.

Figure 6:
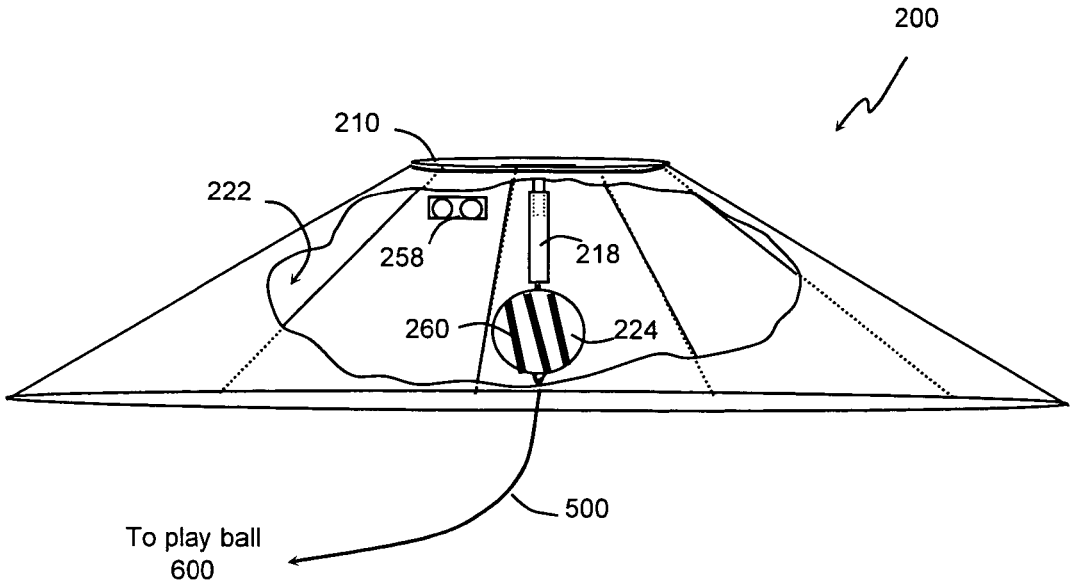
FIG. 6 is an elevated view of sensor head assembly 200 showing an embodiment of spin sensor 214.

FIG. 6 is an elevated view of sensor head assembly 200 showing an embodiment of spin sensor 214. In this embodiment, spin sensor 214 may include an infrared sensor 258 and reflective stripes 260 disposed about clapper 224 to form an optical strobe disk. Alternatively, reflective stripes 260 may be patterned onto coupler 218 as an optical strobe disk. In either case, coupler 218 may include a free spinning quick disconnect element.

In operation, infrared sensor 258 may send out pulsed light patterns that are reflected back by reflective stripes 260 to infrared sensor 258. Infrared sensor 258 may receive the reflected light and convert it into a voltage signal that corresponds to whether play ball 600 is spinning and in what direction (clockwise/counterclockwise) play ball 600 is spinning. The voltage signal may be transmitted to microprocessor 106 (FIG. 1) for processing.

C. Travel Path Sensor 220

As noted above, sensor head assembly 200 of FIG. 3 may include travel path sensor 220, having direction detectors 222 attached to interior 208 of cone 202 and having a clapper 224 attached between coupler 218 and tether 500. Each direction detector 222 may be positioned in a circular array arranged about interior 208.

Figure 7:
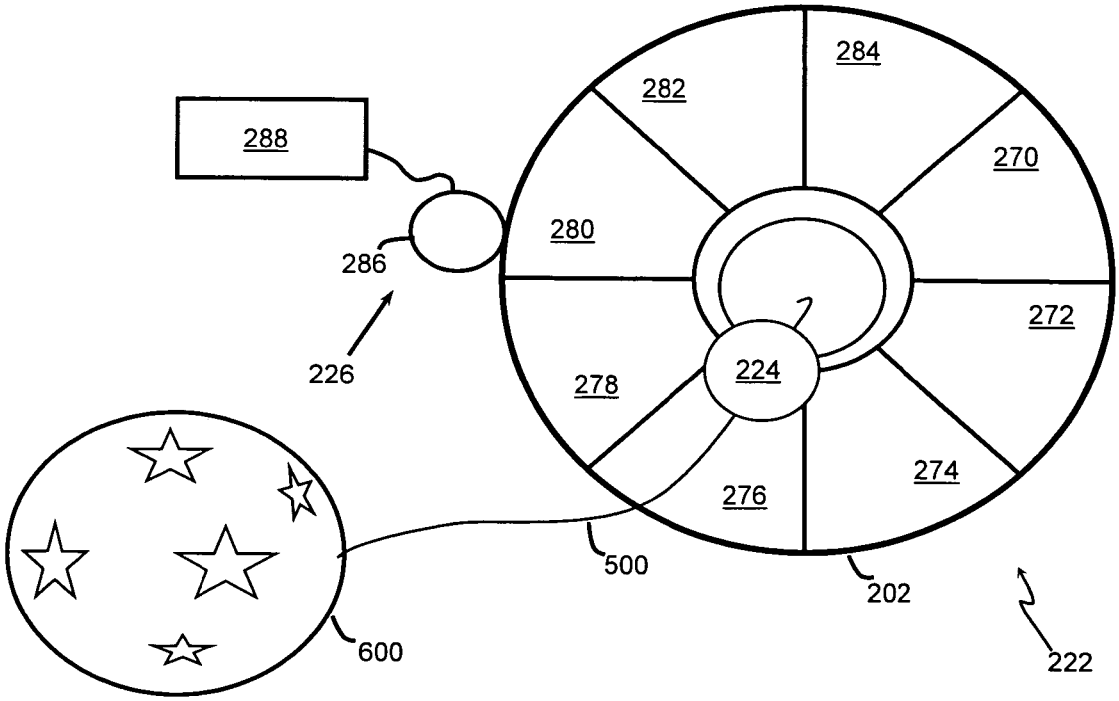
FIG. 7 is a plan view of cone 202 and direction detectors 222.

FIG. 7 is a plan view of cone 202 and direction detectors 222. Direction detectors 222 may include eight direction detectors: direction detector 270, 272, 274, 276, 278, 280, 282, and 284. Each direction detector 222 may include piezoelectric ceramic crystals and/or tactile membrane switches.

When play ball 600 is moved in a given direction, play ball 600 may pull along tether 500. Since clapper 226 may be connected to tether 500, clapper 224 generally may move in the same radial direction as play ball 600. That is to say, with clapper 224 hanging from a position centered within direction detectors 222 and moving in pendulum fashion, clapper 224 may follow the swinging of play ball 600. If sufficient force is applied to play ball 600, clapper 224 may make contact with one or more direction detectors 222.

When membrane based direction detector 222 is struck by clapper 224, a unique analog voltage may be generated by that direction detector that corresponds with the radial movement of play ball 600. This analog voltage may be provided to a conditioning circuit and then to microprocessor 106. Microprocessor 106 may then interpret the signal according to requirements of a currently selected game to determine the relative direction of play ball 600.

While most game playing may utilize game target device 300 to contribute to scores, the direction play ball 600 is moving may be another important element of consideration during game play. Any adjacent pair of direction detectors 222 may work together to provide an indication of a unique direction. Where eight direction detectors 222 are distributed substantially evenly about 360 degree to surround clapper 224, the 360 degrees is actually divided by sixteen slices of 22.5 degrees each. Effectively, a radial movement of play ball 600 may be determined within each 11.25 degrees.

Travel path sensor 220 may operate by tracking movement of a secondary member. In this case, a primary member may be clapper 224 and the secondary member may be the play ball 600. As clapper 224 strikes travel path sensors 220, elastic properties of tether 500 may cause clapper 224 to repeatedly strike travel path sensors 220 over a short period of time. The harder you pluck a guitar string, the more it vibrates. Similarly, the harder play ball 600 is struck, the more tether 500 "vibrate" and faster clapper 224 may strike travel path sensors 220. Accordingly, the dynamic impacts of clapper 224 against travel path sensors 220 may be used to determine a force with which play ball 600 was struck.

A weight of clapper 224 or material of clapper 224 may be adjusted to minimize or eliminate noise from an impact by clapper 224 against ravel path sensors 220. Experiments have shown that using a hallow, light rubber or Styrofoam™ ball as clapper 224 aid in minimizing noise emanating from an impact by clapper 224 against ravel path sensors 220.

Depending on the game, multiples of the 11.25 degrees with adjacent pairs of direction detectors 222 may work together. Such combinations may provide larger divisions, such as 45 degrees, 90 degrees or more. In another embodiment, when a piezo based direction detector 222 is struck by clapper 224, a unique digital signal is the result provided to microprocessor 106, generated by the direction detector that corresponds with the radial movement of play ball 600. In general, the piezo based direction detector signal level is not significant, once converted to a digital signal, while the analog membrane embodiment provides all direction detector signals together as a single analog voltage whereby the voltage level is an indication of the direction detected.

The cone shape of cone 202 is intentional. Since clapper 224 may be suspended from a center point inside a downward facing cone shape of cone 202, the size of clapper 224 and the distance clapper 224 is from the attached point may affect the degree of movement required of clapper 224 to make contact with cone 202. By positioning clapper 224 closer towards narrow opening 204 (FIG. 3), clapper 224 would only need to move a small amount to make contact with cone interior 208. This small movement allows clapper 224 to make contact with one or more of direction detectors 222 and thus allowing the required number of direction detectors 222 to be reduced. Moreover, by increasing a diameter of clapper 224, a distance between clapper 224 and direction detectors 222 is reduced to make travel path sensor 220 more sensitive within a range of allowed movements of play ball 600

During game play, player 104 may be instructed by audio speech files and lights distributed about target device 300 to hit play ball 600 towards one or more directions. The success of player 104 in hitting play ball 600 in the indicated direction may be confirmed by travel path sensor 220.

D. Play Ball Strike Sensor 226

As noted above, sensor head assembly 200 may include a play ball strike sensor 226 to detect a physical strike to play ball 600. As seen in FIG. 7, play ball strike sensor 226 may include a microphone 286 and a hardware circuit 288 to control microphone 286. Microphone 286 may be any device adapted to convert acoustic sound waves into an electrical representation of the sound wave.

In one embodiment, with a piezo element used in force sensor 212 (FIG. 3), the same piezo element may be used as microphone 286 (FIG. 7) to convert acoustic sound waves from a strike by play ball 600 into an electrical representation of the sound wave. In this same embodiment, microprocessor 106 (FIG. 1) may operate to account for the various signals that may coexist in time and or frequency.

An example of a concurrent event requiring exclusion of detection include the situation where an unpredictable play ball strike occurs as spin motor 214 is initiating spin activity. With DC motor 214 (FIG. 5) spinning from an external source of current being provided to energize the motor, vibrations from DC motor 214 may saturate the piezo and may mask the low end audio sensitivity of the piezo. In another embodiment, multiple piezo type direction detectors may convert ambient environmental sounds including the audible play ball "strike."

In operation, play ball strike sensor 226 (FIG. 7) may continuously receive environment room level audio input, which typically measures an average of 74 to 82 dB. The contact from player 104 striking play ball 600 may emit an acoustic sound wave. Microphone 286 may receive this acoustic sound wave and convert the acoustic sound to a voltage wave representative of the acoustic sound wave. This voltage wave may then be processed by hardware circuit 288, which may provide a dedicated function filtered for 180-200 Hz, 12 dB 6-pole bandpass. Preferably, whenever a bandpass filtered audio level raises 5-6 dB above the average ambient room level and a single detected event lasting for a duration of less than 200 mS occurs, then a strike to play ball 600 shall be confirmed. Play ball strike sensor 226 may include microphone 286 and a hardware circuit, where the hardware circuit is configured to confirm a strike to play ball 600 on receiving a 200 Hz audio frequency input lasting less than 200 mS and at-least 5 dB above an ambient room level. The voltage wave corresponding to the confirmed strike then may be rectified by hardware circuit 288 to a DC component representation. This DC component representation may then be fed to microprocessor 106 through a signal multiplexer for further processing. An alternate embodiment may utilize a simple voltage divider circuit to shift the static DC level to one-half of the of system voltage source to allow a differential measurement to be performed by microprocessor 106.

II. Target Device 300

Figure 8:
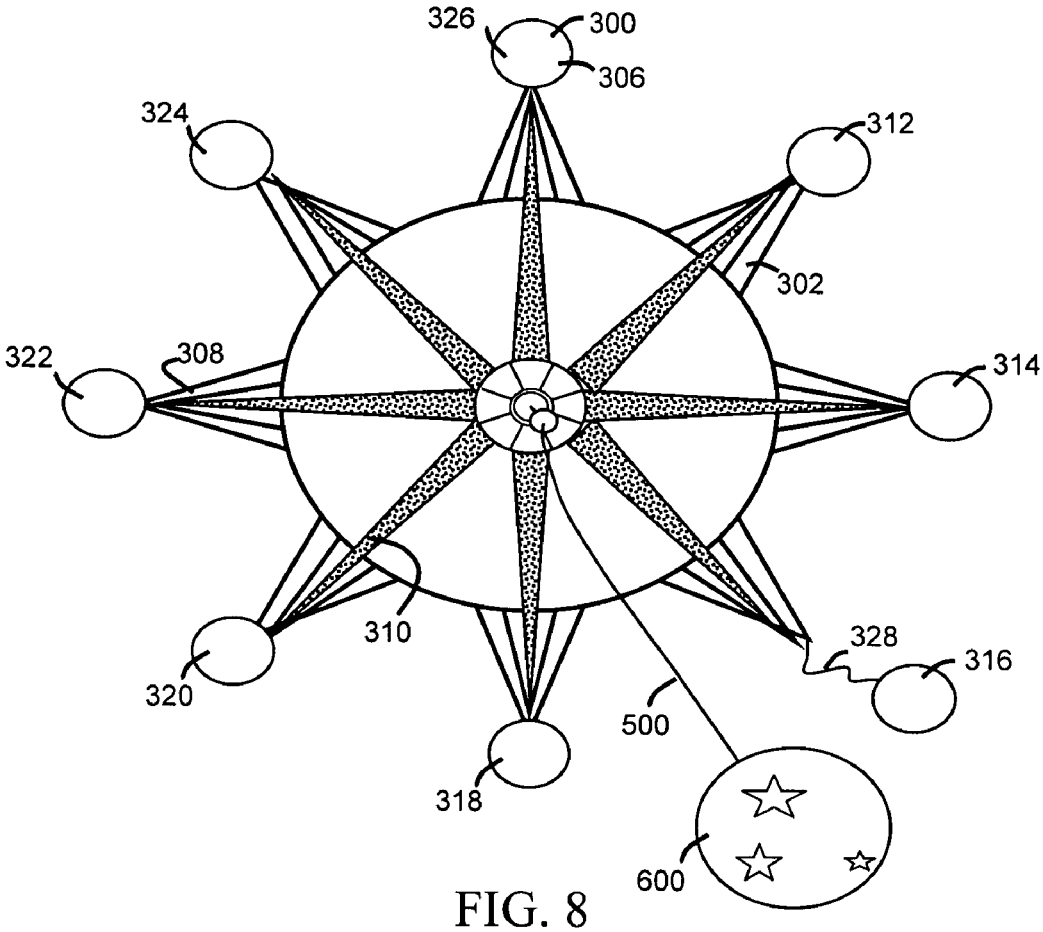
FIG. 8 is a plan view of target device 300.
Figure 9:
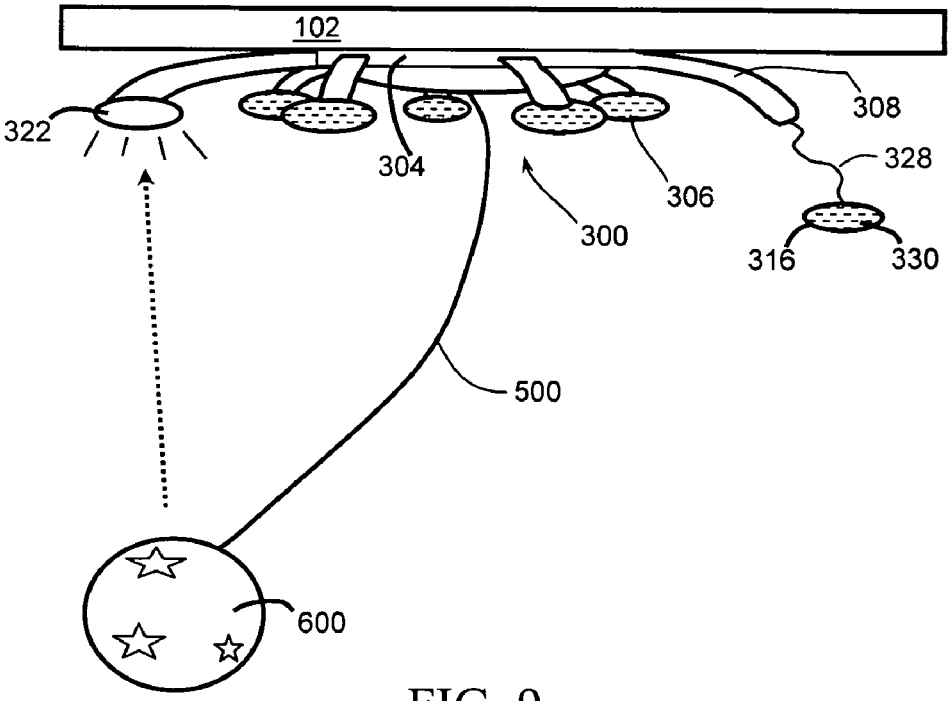
FIG. 9 is an elevated view of target device 300.

As noted above, game assembly 100 may include target device 300 to produce audio/visual feedback. FIG. 8 is a plan view of target device 300. FIG. 9 is an elevated view of target device 300. Included with target device 300 may be a frame 302, a cabinet 304, and targets 306.

Frame 302 may couple targets 306 to cabinet 304. Cabinet 304 may house game electronics such as controls system 700 (FIG. 1) and hardware circuit 288 (FIG. 7). In addition, cabinet 304 may include hardware features that permit securing game assembly 100 to mounting platform 102.

In one embodiment, frame 302 may have a plurality of frame arms 308 extending radially outward, with one target 306 attached to each frame arm 308. Alternatively, frame 302 may be dome shaped with no long legs or protrusions extending from the main body where targets 306 may be equally positioned around the surface of the dome.

Figure 10:
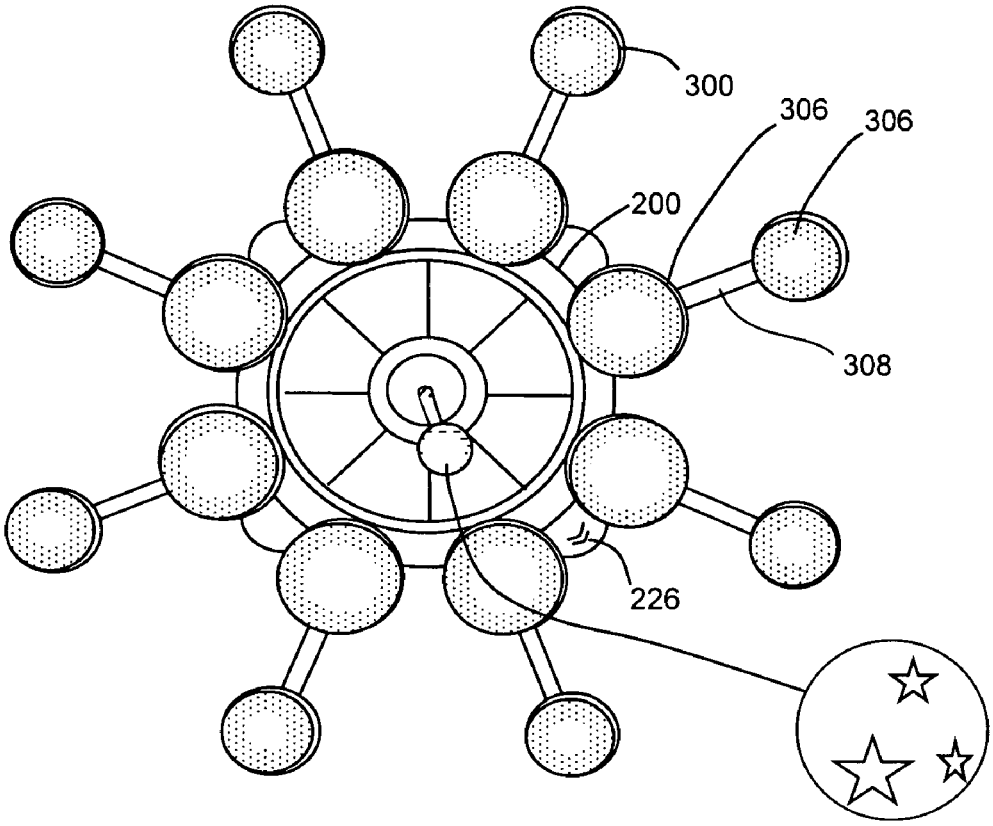
FIG. 10 is a plan view of target device 300 showing at least two targets 306 attached to at least one frame arm 308.
Figure 11:
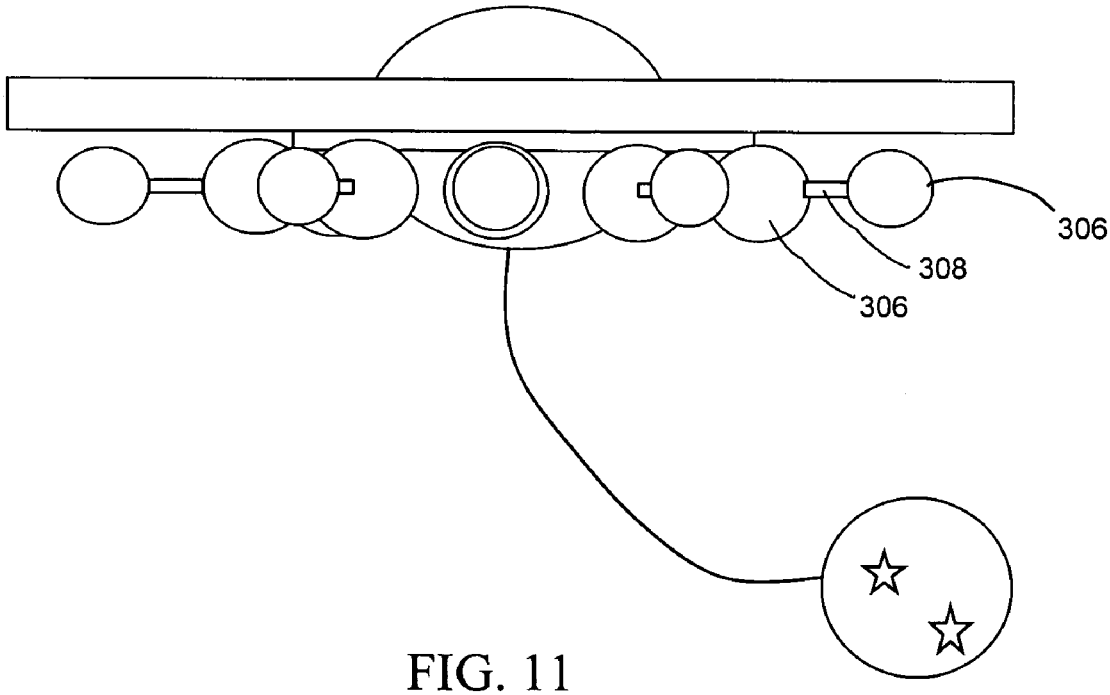
FIG. 11 is a plan view of target device 300 showing at least two targets 306 attached to at least one frame arm 308.

In another embodiment, frame 302 may have a plurality of frame arms 308 extending radially outward, with at least two targets 306 attached to at least one frame arm 308. FIG. 10 is a plan view of target device 300 showing at least two targets 306 attached to at least one frame arm 308. FIG. 11 is a plan view of target device 300 showing at least two targets 306 attached to at least one frame arm 308.

Returning to FIG. 8, frame 302 may allow each target 306 to present the largest profile to play ball 600 due to a plurality of frame arms 308 extending radially outward. Frame 302 also may include decorative features 310. In one embodiment, frame 302 may be made of a high strength plastic. In another embodiment, frame 302 may be injected or molded polystyrene, such as Styrofoam™.

Targets 306 may include target 312, 314, 316, 318, 320, 322, 324, and 326. Each target 306 may serve as a point of aim for play ball 600. Targets 306 need not be rigidly fixed to frame 302. In one embodiment, a cord of each target may be attached to its own retractable device so that the target may be pull, moved, and position in different locations within the reaches of play ball 600. For example, target 316 may be removably attached to frame 302 through a retractable cord 328. This may allow extended positions about the ceiling or even the walls of the room to be utilized for target mounting. Another embodiment may provide wireless targets 306 not attached to frame 302 to allow even more flexibility without restricting the length of tether 500 and related dressing of attached cording.

More often than not, an object of a game played using game assembly 100 may be to hit an indicated target 306 using play ball 600 or at least come close to an indicated target 306. Accordingly, each target 306 may include a target strike sensor 330 (FIG. 9) to detect and identify independently if and when play ball 600 makes contact with that particular sensor.

To determine if and when a target 306 is contacted by play ball 600, several different types of target strike sensors 330 may be implemented. For example, a target strike sensor 330 of targets 306 may include a membrane switch, a micro switch, a piezoelectric element, a commercially available proximity detector and a light emitter with reflection detector. Target strike sensors 330 may be direct contact sensors, requiring play ball 600 to make actual contact with a target strike sensor 330 to register a contact, or may be indirect, proximity sensors.

Depending somewhat on the game playing environment, experiments have shown that some types of sensors may provide advantages over others. For example, a sensor utilizing a light emitter and a light detector is one of the most robust sensors for game assembly 100 because there are no physical contacts to wear out. One problem the inventors of game assembly 100 overcame as part of this approach was environmental lighting, which may saturate a light detector with environmental light to prevent the light detector from receiving light signals from the light emitter.

Figure 12:
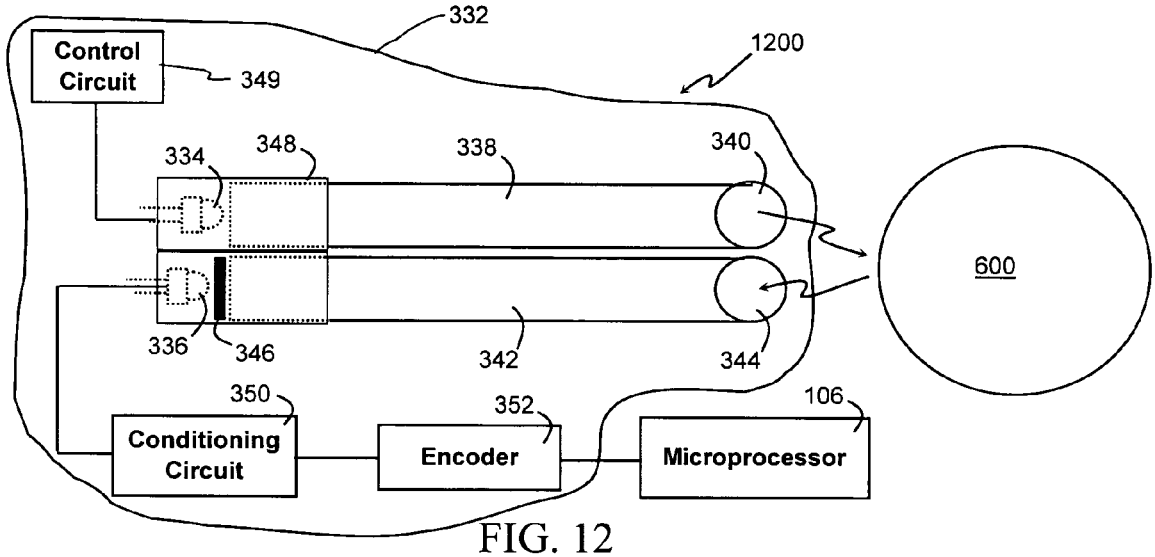
FIG. 12 is a schematic 1200 of a proximity sensor 332 that may be utilized in target strike sensors 330.

Target strike sensors 330 additionally may include a proximity sensor 332. FIG. 12 is a schematic 1200 of a proximity sensor 332 that may be utilized in target strike sensors 330. Proximity sensor 332 may include an emitting diode 334, a detector diode 336, an emitter light pipe 338 having a light emitting end 340, and a detector light pipe 342 having a light receiving end 344. Emitter diode 334 may be position to communicate infrared light with emitter light pipe 338 and detector light pipe 342 may be position to communicate with detector diode 336 to receive incoming light signals.

To counter the environmental light typically experienced by game assembly 100, both light emitting end 340 and light receiving end 344 may be position so that an opening faces downward. For example, an axis through light emitting end 340 substantially may be perpendicular to a surface onto which game assembly 100 may be mounted. This works towards screening out some environmental light, which typically is directed downward as well. It should be noted that bright environmental lighting, especially when aimed or directly reflected at proximity sensor 332, may saturate proximity sensor 332 and if with sufficient IR energy may prevent proximity sensor 332 from receiving signals from emitter 334. This may be at a level equal to the average IR energy received at a given time when play ball 600 is in front of a given emitter/detector array.

Even with light emitting end 340 and light receiving end 344 facing downward, environmental lighting may cause detection problems. Here, a filter 346 (FIG. 12) may be position between detector diode 336 and detector light pipe 342 to isolate detector diode 336 further from environmental lighting conditions. Preferably, filter 346 may permit infrared light to pass through and screen out all other light, such as visible light. Additionally, a black sleeve 348 may be wrapped around diodes 334, 336 and light pipes 338, 342 to secure proximity sensor 332 together as well as prevent stray infrared light pulses.

In operations, emitting diode 334 may send out infrared light pulsed downward through light emitting end 340 at an emitting frequency range of between 100 Hertz (Hz) and 200 Hz as controlled by control circuit 349. During stationary operations when play ball 600 is not moving, detector diode 336 may be unable to detect light from emitting diode 334 due to the physical arrangement of light emitting end 340 and light receiving end 344. However, as play ball 600 is brought close to a target 322 (FIG. 9), for example, the pulses from emitting diode 334 (FIG. 12) may be reflected off play ball 600 to light receiving end 344, where detector light pipe 342 may channel this infrared light to detector diode 336.

To process received infrared light signals, targets 306 may include a conditioning circuit 350 coupled to a multiplexer (encoder) 352. Each infrared light signals received from a target 306 may be feed into conditioning circuit 350. There, lower frequency light pulses received by detector diode 336 may be rejected. In one embodiment, frequency light pulses of less than one-half the lower value of the emitting frequency range are rejected. In another embodiment, frequency light pulses of less than 50 Hz are rejected. Conditioning circuit 350 may include a resistor/capacitor High-Pass filter-to-filter low frequency light signals. Bandwidth limiting may prevent higher frequency light signals such as those typically seen in television infrared remote controls from activating and saturating the sensor.

Infrared light signals received and not rejected may be condition by conditioning circuit 350 to provide a "target acquired" signal. The target-acquired signal may be generated from a gate having a Schmitt trigger feature. Once generated, the target-acquired signal may be passed to encoder 352, where a final encoded logic level may then be provided to microprocessor 106.

III. Player Feedback System 400

Figure 13:
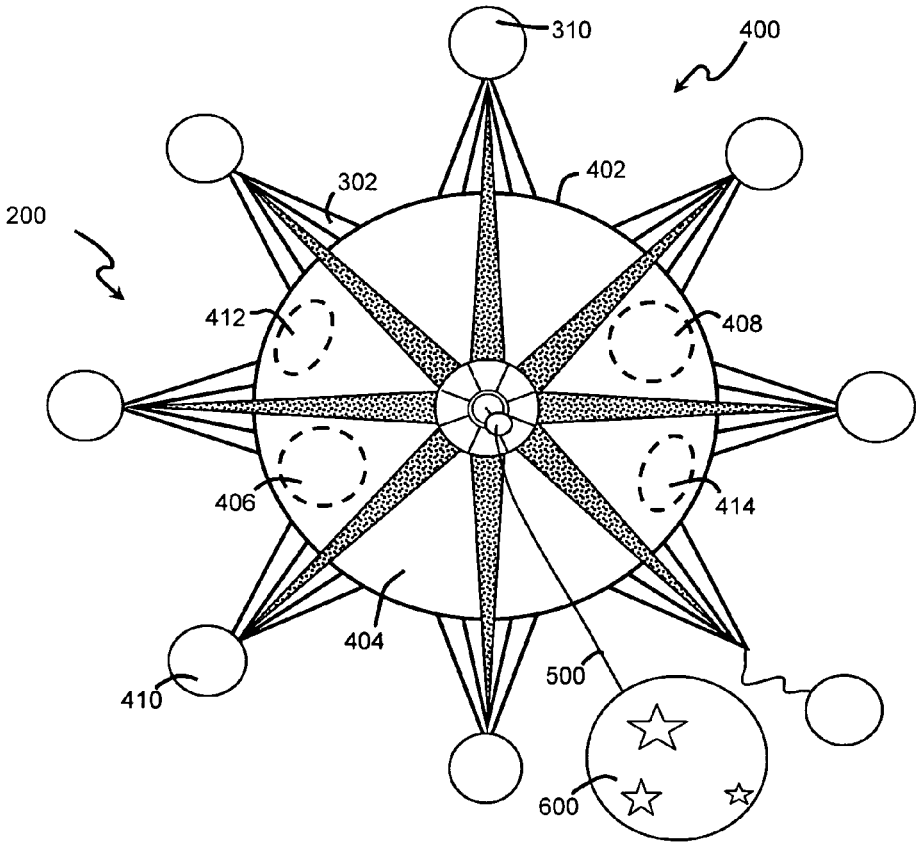
FIG. 13 is a plan view of sensor head assembly 200 illustrating player feedback system 400.

Player feedback system 400 may include sound effects, music, speech, and light effects. Each of these may work independently or together to enhance and guide game playing activities. FIG. 13 is a plan view of sensor head assembly 200 illustrating player feedback system 400.

A. Audio Subsystem

Player feedback system 400 may include a shell 402 having cavities 404, a first speaker 406, and a second speaker 408. First speaker 406 and second speaker 408 each may be four-inch diameter speakers. To provide sound effects, music, and speech in high quality stereophonic sounds in a typical environment into which game assembly 100 may reside, experiments have shown that first speaker 406 and second speaker 408 must be driven by no less than one watt (1 W) of power.

Shell 402 may be positioned about cabinet 304 (FIG. 9) and reside on an upper side of frame 302. First speaker 406 and second speaker 408 may be mounted within a cavity of cavities 404. Preferably, these speakers may be positioned on opposite radial ends of shell 402 as illustrated in FIG. 13. First speaker 406 and second speaker 408 may be connected to local output 112 (FIG. 1) by wires (not shown).

Stored within memory 108 of processor 106 (FIG. 1) may be libraries of files, such as a MIDI sound library and a game speech library. Various game related sound and speech selections may be customized for personal motivation during selected game plays.

The MIDI sound library may have music style files and instrument files that are adapted to be provided as MIDI wave files from ROM storage and flash memory of memory 108. Microprocessor 106 may provide independent control over music timing, active instrument selection, and audio volume as a function of both the actions generally relating to the specifics of the game being played and the detected activities of play ball 600.

Speech files may play a significant role in several game relate functions; identifying the various games by name, providing game instructions, coaching and scoring information. The game speech library may have speech based sound files in a variety of languages adapted to be provided as flash memory of memory 108.

Memory 108 may include a variety of speech files to support a wide range of games. For example, a speech file may contain dialogue specific to medical applications such as physical therapy or agility determination. Other speech files may contain memory and exercise dialogue, various educational dialogues such as foreign languages, schooling for math, alphabet, animals, rhymes, and dialogues directed to the player unrelated to the game being played, such as personal messages, advertising and promotional applications.

As noted above, player 104 may strike play ball 600 to their own rhythm. This may be referred to as Player Beats-Per-Minute (PBPM), where each change in PBPM rhythm may cause a different audio and/or visual signal. A melody or sound effects pattern may become an integral part of a specific game whereby a baseline Player Beats-Per-Minute is established, at about 10% slower than ideal, and as the player consistently strikes the ball to a regular beat the BPM settles in at the ideal speed.

A general idea is to consider striking play ball 600 as one of the instrumentals representing a 200 Hz staccato tone and to counterpoint with other patterns in the melody of a particular musical piece. In one embodiment, a single instrument may play a first melody at a first PBPM. Then, if a steady pattern of different TUG peaks is detected by force sensor 212, another instrument may begin to play a second melody that may combine with the first melody. Either this may continue until all instruments of a particular song play or the rhythm pattern is broken, causing one or more instrument melodies to cease from playing.

B. Visual Subsystem

Player feedback system 400 additionally may include target displays 410, a power display 412, and a test display 414. Target displays 410 may be light emitting diodes (LEDs) disposed within each target 306. When proximity sensor 332 of a particular target 306 registers a target-acquired signal, a target display 410 may light to give a visual indication of the target acquired signal to player 104.

Both power display 412 and test display 414 may be though of as indicator lights. Each may be disposed within a cavity 404 as illustrated in FIG. 13 and may include one or more LEDs to communicate visual signals. Illumination from power display 412 may indicate that power is being provided to game assembly 100 and that the system is "on." Test display 414 may provide visual feedback as to whether a certain system is on or is working.

Figure 14:
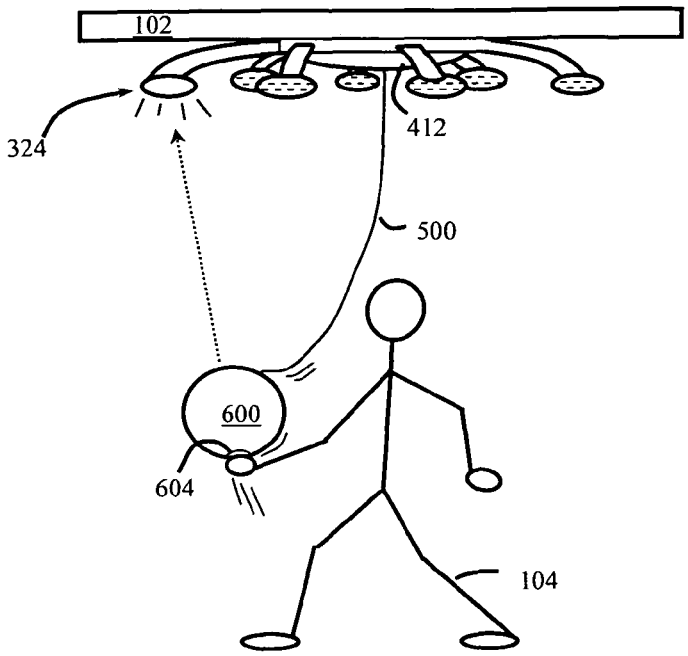
FIG. 14 illustrated player 104 hitting underneath play ball 600 at location 604 to drive play ball 600 directly at target 324.

In addition to indicating that game assembly 100 is on, power display 412 may be used to instruct player 104 on how to hit play ball 600. In general, there are two basic methods to urge play ball 600 to make contact with targets 306: directly or indirectly. FIG. 14 illustrated player 104 hitting underneath play ball 600 at location 604 to drive play ball 600 directly at target 324. Basically, player 104 may use an underhand motion to hit play ball 600 to propel play ball 600 at target 324. This may or may not initially stretch tether 500.

Figure 15:
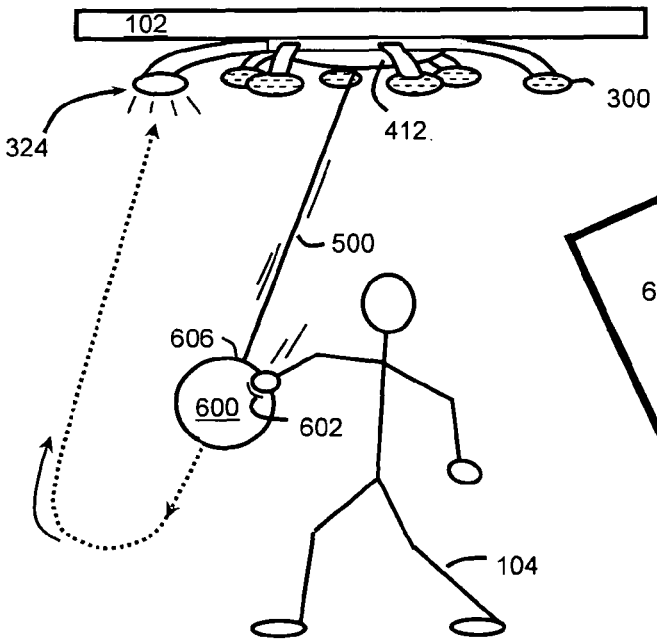
FIG. 15 illustrated player 104 hitting above play ball 600 at location 602 to drive play ball 600 downward (or sideways)

FIG. 15 illustrated player 104 hitting above play ball 600 at location 602 to drive play ball 600 downward (or sideways). As tether 500 stretches then recoils as shown in FIG. 15, recoil energy stored in tether 500 may work to cause play ball 600 to slingshot towards target 324. This indirect method adds to the multitude of games that may be played using game assembly 100.

To instruct player 104 on how to hit play ball 600, power display 412 may be multicolored. When power display 412 is red, for example, player 104 may be instructed to use an underhand motion to hit play ball 600 towards a lit target 324. When power display 412 is yellow, for example, player 104 may be instructed to use an overhand motion to hit play ball 600 indirectly towards a lit target 324. Whether red or yellow, if power display 412 is lit, this may mean that power is being provided to game assembly 100.

It may be important to determine whether player 104 followed instructions on how to hit play ball 600. Force sensor 212 (FIG. 2) may aid microprocessor 106 in determining which method player 104 utilized to drive play ball 600 to the lit target. A relatively high amplitude force signal, just before contact with a target 306, may indicate a downward or sideways strike motion by player 104. In contrast, a relatively low amplitude force signal just before contact with a target 306 may indicate an upward strike motion by player 104.

Alternatively, microprocessor 106 may use the time between a strike against play ball 700 and a target-acquired signal produced by a target 306 as confirmed by force sensor 212. Recall that microphone 286 (FIG. 7) may sense when play ball 700 is struck by player 104. If power display 412 (FIG. 15) is yellow and player 104 followed instructions to strike down on play ball 600, then microprocessor 106 may use input from force sensor 212, microphone 286, and a target strike sensor 330 to verify that player 104 followed instructions to strike down on play ball 600.

Also recall that in experimentation, a four-foot length of 0.055-inch diameter round cord for tether 500 and a three ounce, ten inch diameter vinyl ball for play ball 600 were used to determine that the rotational friction resistance of spin sensor shaft 216 may not be greater than a torque 2.5 to 3 inch-grams. If tether 500 has a diameter, length, and energy storage ability as a function of the weight of play ball 600 (such as is identified in the prior sentence), then the time required for play ball 600 to fully extend tether 500 as measured from the moment player 104 strikes play ball 600 may be approximately the same as the time required for tether 500 to sling play ball 600 to a target 306.

Tether 500 may include translational kinetic energy. The amount of translational kinetic energy (from here on, the phrase kinetic energy will refer to translational kinetic energy) which an object has depends upon two variables: the mass (m) of the object and the speed (v) of the object. The following equation 1 is used to represent the kinetic energy (KE) of an object.

$$KE=\tfrac{1}{2}(m)(v)^2 \tag{1}$$

where m=mass of object, and v=speed of object.

Equation 1 reveals that the kinetic energy of an object is directly proportional to the square of its speed. That means that for a twofold increase in speed, the kinetic energy will increase by a factor of four; for a threefold increase in speed, the kinetic energy will increase by a factor of nine; and for a fourfold increase in speed, the kinetic energy will increase by a factor of sixteen. Thus, a harder strike to play ball 600 may quickly build energy. Since game assembly 100 has little control over how hard player 104 may hit play ball 600, this embodiment works to limit the mass of play ball 600 to reduce the potential for kinetic energy.

Thus, by carefully choosing the parameters of tether 500 and play ball 600, then the time required for play ball 600 to extend tether 500 fully from the moment player 104 strikes play ball 600 may be the same as the time required for tether 500 to sling play ball 600 to a target 306. Moreover, the time required for peak 248 in waveform signal 246 to travel from blind zone window 244 (FIG. 4) to peak 248 and back into blind zone window 244 may be representative of player 104 striking down on play ball 600. For example, if microprocessor 106 determine 30 milliseconds have passed between when waveform signal 246 left blind zone window 244 and returned to blind zone window 244, then microprocessor 106 may conclude that player 104 struck down on play ball 600.

An additional display to provide game scoring information or instructions may be added. To avoid additional costs and complexity, game scoring information or instructions may be provided by speech files conveyed by first speaker 406 and a second speaker 408. Moreover, audible and visual alarms may be provided by both the audio and visual subsystem if safety limits, such as too much tug on play ball 600, are about to be breached.

IV. Tether 500

As noted above, tether 500 may connect play ball 600 to cone 202. Tether 500 may be any elongate flexible member such as a cable, cord, or rope and may work to limit the distance play ball 600 moves away from player 104 upon being struck. In a preferred embodiment, tether 500 may be a small round elastic cord with a diameter of approximately 0.055 inches and a relaxed, unstretched length of approximately 4-5 feet. The fully stretched length may extend to 100% (±10%) of the unstretched length. A preferred composition of tether 500 may also include approximately 58% rubber and 42% polyester. This amount of elastic cord typically may weight less than 3 grams. Rhode Island Textile Company of Pawtucket, R.I., may be a source of this type of cord.

To place play ball 600 at chest level for one player 104 may require using three feet of elastic cord between play ball 600 and clapper 224. Another player 104 may require five feet of elastic cord to place play ball 600 at chest level for that player. Replacing tether 500 for each player would be cumbersome.

It is desirable that the height at which play ball 600 is suspended above the ground may be adjustable without needing to replace tether 500 in its entirety each time the play ball 600 height is adjusted. This may be a frequent requirement, so the technique must be reliable and simple to adjust for any given player's personal preference.

To accommodate a nominal variety of player heights and desired hanging positions of play ball 600, the length of tether 500 may be easily re-adjustable. The quick adjustment range shall be from a minimum of 3 feet in length to approximately 7 feet.

In one embodiment, play ball 600 includes with a special pocket having an elongated cone shaped tunnel inside the special pocket. For example, the cone shaped tunnel may have the dimensions of 0.70 inches maximum on a bottom opening and 0.10 inches maximum on a top opening. The elongated cone shaped tunnel may include a core and is large enough to allow for retention of an excess portion of tether 500. The excess portion of tether 500 may be wrapped around the core. The core may be made of Styrofoam or similar ultra lightweight elongated shape to help player 104 quickly coil the excess portion of tether 500 and prevent the excess portion of tether 500 from being pulled out of the top opening of the elongated cone shaped tunnel.

To adjust the length of tether 500, player 104 may start with that portion of tether 500 hanging from clapper 224. First, tether 500 may be fed into the smaller opening of tether 500 retention tunnel on the top of play ball 600. The retention tunnel may be located adjacent to an air valve of play ball 600. With continue feeding, tether 500 may exit out the opposite side (bottom) of play ball 600 through the wider opening. While holding play ball 600 at the desired height, player 104 may grab tether 500 at its point of exit from play ball 600 and remove any slack between play ball 600 and clapper 224. While holding tether 500 with one hand, player 104 may then slide play ball 600 up tether 500 (about the diameter of play ball 600) and mark or note that point. Any excess cord may then be wrapped around the core up to the marked point. Then the whole cord wrapped assembly may then be pulled up into the tunnel. Due to the cone shape of the tunnel, the wrapped assembly becomes tighter the deeper it settles in the tunnel. A play ball 600 having a 10-inch diameter with this type of tunnel attribute may weight approximately 54 grams. The excess cord may weigh up to 2 grams and the core may weigh another 2 grams.

V. Play Ball 600

Play ball 600 and tether 500 are two variables that may work together to compose an overall response of game assembly 100. The physics of the relationship between the properties of play ball 600 and tether 500 allows for some degree of personalization or fine-tuning of play ball 600's reaction to forces applied by player 104.

The physical size of play ball 600 plays a significant role in the response time and movement of play ball 600. In a preferred embodiment, play ball 600 may be a 30-gram vinyl, air filled ball of approximately 10 inches in diameter. There are limitations, however.

Play ball 600 may have a diameter of no more than 20 inches. A reason for this is that air resistance to swinging movement of ball greater than 20 inches is much greater than that of a 10" ball and ultimately dampens the ball's movements in all directions. In addition, a bigger ball is a heavier because there is more material used in the bigger size ball. A play ball 600 having a diameter of greater than 20 inches would require a thicker tether 500 to improve the response of a heavier ball. However, the weight of such a play ball would negatively affect the response of the sensors. Thus, in one embodiment, a diameter of Play ball 600 is not to exceed more than 20 inches.

Another requirement for play ball 600 is that it may have a diameter of no less than 6 inches. A reason for this is that experiments have shown that a vinyl play ball 600 smaller than 6 inches in diameter is too light and does not work well with a 0.055" round elastic tether 500. This size tether 500 may be a preferred baseline size. In addition, a piezoelectric sensing element utilized in force sensor 212 has had problems detecting the activities of this lighter play ball 600 and smaller total signal range anticipated to be down inside the electronics sensor noise floor. In general, for a smaller play ball 600 to perform in a "kinetically balanced" manner either tether 500 may be lighter or play ball 600 of a diameter less than six inches may need to be made from a material other than lightweight vinyl. Yet not to exceed the previously identified weight limit of play ball 600.

A further requirement for play ball 600 preferably is that the weight of play ball 600 may be no greater than 90 grams. One reason for this is the weight of play ball 600 is multiplied by the force it encounters from player 104 striking play ball 600 and may the peak "Tug Safety Limit" (TSL) be exceeded, both play ball 600 and tether 500 may automatically detach from clapper 224. A second reason is that the structural strength of force sensor 212 has a limitation that, if exceeded, will damage force sensor 212 by being permanently deformed.

In a preferred embodiment, no electronics are contained within play ball 600. This may provide an end user with a safe and lighter weight interface.

Various games may require different play balls 600. A game assembly 100 may include a broad range of lightweight balls. Although some balls may have a stem to facilitate attaching play ball 600 to tether 500, many balls may not have such a stem. To accommodate stemless play balls 600, a generic method of attaching to any ball may be provided with game assembly 100. Preferably, this ball-to-cord adapter may be very small, flexible, lightweight, and very durable. Since it may be in contact with a persons' skin, the ball-to-cord adapter may not be abrasive, hard or provide a sharp edge, under all conditions.

FIG. 16 illustrates a ball-to-cord adaptor 606. Ball-to-cord adaptor 606 may include a round base 608 defining a diameter of approximately 1.75-inches. Round base 608 may be made of a material adapted to deform under slight pressure. A material for round base 608 may be rubber. Adhesive 610 may be disposed on an interior 612 and ball-to-cord adaptor 606 additionally may have a recessed string loop 614. With round base 608 deformed to fit about play ball 600 and adhesive 610 attached to a play ball 600, loop 614 may be connected to tether 500.

Alternatively, ball-to-cord adaptor 606 may be a bag composed of soft netting having an opening that may be secure a play ball 600 inside through a locking ring, where the locking ring also may be attached to tether 500. In another embodiment, ball-to-cord adaptor 606 may be attached to a bottom of a play ball 600 while a top of the same play ball 600 may have another ball-to-cord adaptor 606 to provide a double-ended play ball. This double-ended play ball may provide accelerated play ball responses and may be somewhat less predictable to provide more dynamics to game play. Ball-to-cord adaptor 606 may be sold separately from game assembly 100 through a website.

Play ball 600 may be used for advertising. The advertising aspects and applications for more personalized designs placed on lightweight vinyl balls are easily accommodated. An example of promotional application is to have the appropriate picture, message, or pattern applied to play ball 600, then display game assembly 100 in a public place with it configured automatically to play a given game with the sounds and in-game award announcements selected by the sales department.

Play ball 600 may be hit with the hands and different parts of the user's body, such as the feet or head. A stick or bat may be employed, similar to T-ball.

VI. Controls System 700

Game assembly 100 is modular to allow for significant expansion of the interactive functions. Integrated subsystems and functionality includes specific firmware based operations to support the required level of modularity. Several types of sensors may be employed to determine play ball 600 movements and to enhance game playing activities for the desired interactive functionality. In addition, game assembly 100 may utilize an embedded database of audible and visual responses intended to enhance game playing activities. By accessing a remote website with a local computer having supplied software, a user of game assembly 100 may change resident games, messages, sound effects, and music styles as desired by the user's specific venue or application. Central to this modularity is controls system 700.

Figure 17:
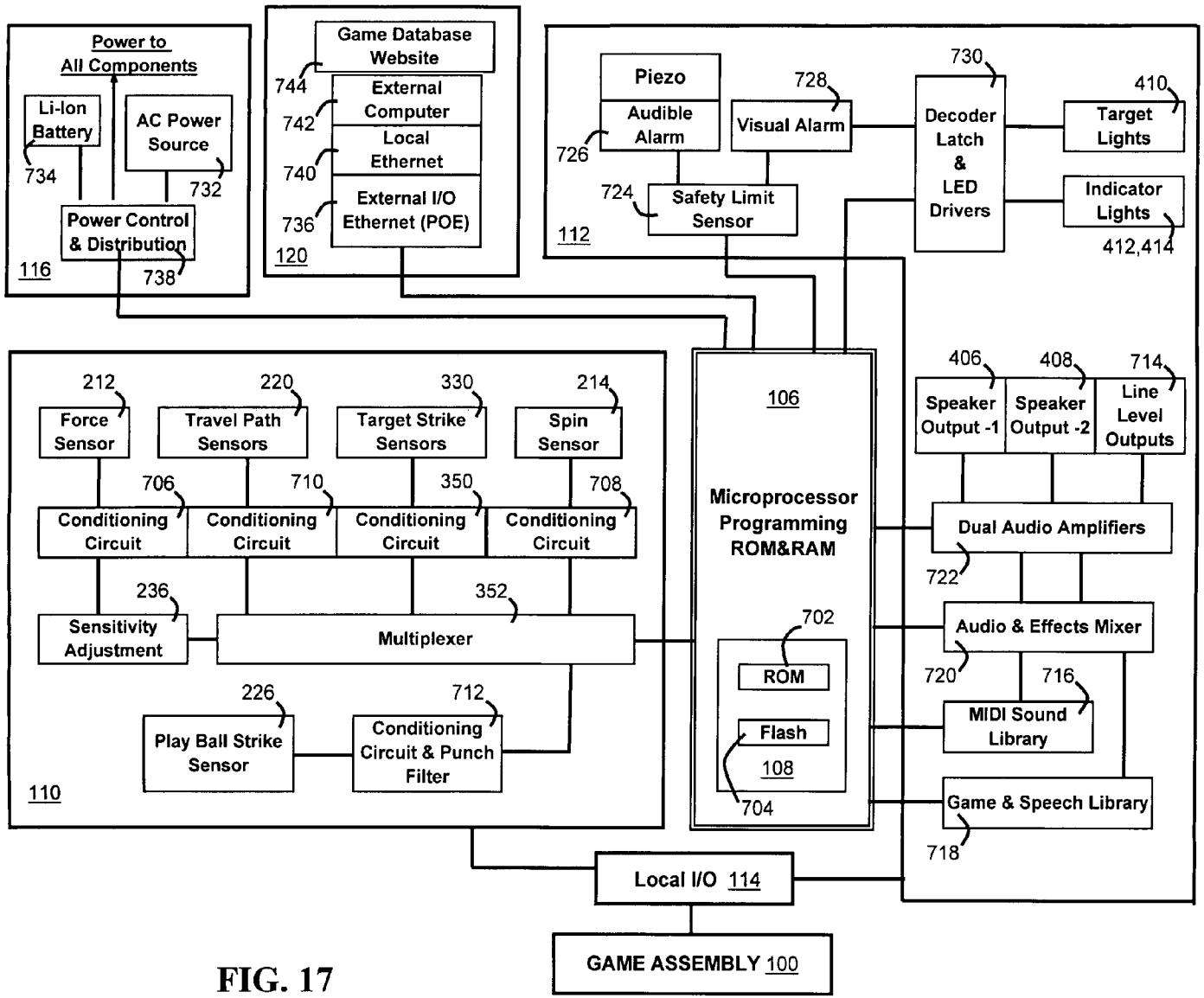
FIG. 17 is a schematic of controls system 700 of game assembly 100.

FIG. 17 is a schematic of controls system 700 of game assembly 100. As noted above, controls system 700 may include a microprocessor 106 having a memory 108, a local input 110, a local output 112, and a local in/out (I/O) bus 114. Local input 110 may receive game signals from game assembly 100 through local I/O bus 114 and transmit them to microprocessor 106. Microprocessor 106 may process these signals and transmit the processed signals back to a player 104 through local output 112 and local I/O bus 114.

Controls system 700 additionally may include a power system 116 and a remote I/O bus 120 to communicate with remote systems, such as those connected to the Internet. Microprocessor 106, local input 110, local output 112, local I/O bus 114, power system 116, remote I/O system 120 will be discussed in more detail below.

A. Microprocessor 106

Microprocessor 106 may be any central processing unit (CPU) fabricated on one or more chips, containing the basic arithmetic, logic, and control elements for processing data. In another embodiment, microprocessor 106 may be a field programmable gate array (FPGA) fabricated on a single chip. Included within memory 108 of microprocessor 106 may be a read only memory (ROM) 702 and a flash memory 704. Firmware programming for game assembly 100 may reside inside ROM 702 protected from attack. Microprocessor 106 may utilize flash memory 704 to store games and some sound related libraries. In operation, microprocessor 106 may monitor both analog and digital signals provided by game assembly 100.

To keep costs down, microprocessor 106 may have very limited source and sink drive current capacity. Thus, microprocessor 106 may be unable to interface directly with light emitting diodes (LEDs) and other such devices. To protect microprocessor 106, it is preferable that none of the I/O ports of microprocessor 106 directly interface with any of game assembly 100 sensors or with the outside world. Rather, microprocessor 106 may accept conditioned input signals from all sensors or switches and, based on game or other related programming, may determine an appropriate action to perform.

B. Local Input 110

Microprocessor 106 may receive signals from local input 110. Local input 110 may include five sensors: force sensor 212, spin sensor 214, travel path sensor 220, play ball strike sensor 226, and target strike sensor 330. Each sensor may generate a voltage when stimulated.

In general, all sensor signals may be conditioned before being feed to input ports on microprocessor 106. For example, force sensor 212, spin sensor 214, travel path sensor 220, play ball strike sensor 226, and target strike sensor 330, each may have a respective conditioning circuit 706, 708, 710, 350, and 712. Signal conditioning generally may include one or more of the following: 1. Schmitt Trigger—to clean up analog signal for digital use; 2. High Pass Filter—to reduce environmental influences; 3. Band Pass Filter for play ball strike sensor 226- to extract play ball 600 striking information; and 4. Signal Level Amplification—to make useable piezoelectric and motor voltages.

The conditioning circuits for force sensor 212, spin sensor 214, travel path sensor 220, and target strike sensor 330 each may be fed through a multiplexer 352 before being sent to microprocessor 106. Conditioning circuit 712 of play ball strike sensor 226 additionally may include a punch filter to permit insertion of a corrected audio part into a previously recorded track by going into and out of record mode at designated time. Moreover, between conditioning circuit 706 and multiplexer 352, force sensor 212 may include sensitivity adjustment 236 as discussed in connection with FIG. 4.

While signals from force sensor 212, travel path sensor 220, play ball strike sensor 226, and target strike sensor 330 are converted and processed as digital states, spin sensor 214 may generate a polarity based analog signal. Signal polarity may be accounted for in the processing of game play data.

C. Local Output 112

Microprocessor 106 may send signals to local output 112. Local output 112 may include target displays 410, power display 412, test display 414, first speaker 406, second speaker 408, and an audio line output 714. Microprocessor 106 output ports may control all output signals, such as LED indicators for Targets, LED indicator for "Game Selection" activities, and audio sounds to announce players score and to play music. While microprocessor 106 may directly control the target display driving circuitry, LED "ON" and "OFF" states may be latched by an external CMOS latching decoder with the appropriate drive current.

Local output 112 additionally may include a MIDI sound library 716 and a game and speech flash library 718, each connected to an audio and effects mixer 720 and a dual audio amplifier 722. All speech file terms within speech flash library 718 may be cross-referenced to the same like in any given available language, such as numbers and alphabet. This fundamental feature may help players to learn bits of other languages. Local output 112 also may include a safety limit sensor 724 having both an audible alarm 726 and a visual alarm 728. Lights 410, 412, and 414 of local output 112 may be attached to decoder latch and LED drivers 730.

A display subsystem may include target LEDs, Tug First, Game Select, Power ON, and Safety Limit Alarm subsystems. Target LEDs may identify game required target(s) to strike with the ball and indicate that player 104 acquired the right game target. Tug first may indicate that "TUG" is not required prior to hitting next target (Red LED from around the TUG sensor). "Game Selection" time and to indicate target LEDs are temporarily assigned as game related selection indicators. This LED may illuminate and flash at a 2 HZ rate while game selections are available and may be the same LED as the LED used to indicate Power "ON." A "Game Selection"

indicator LED is required to indicate and coordinate the time for game selection. And for safety limit alarm, force measured from TUG sensor (display variable intensity of one LED or blinking speed).

Target displays 410 (FIG. 17) may provide both identification of real-time game targets that are to be struck with play ball 600 and identification of those targets with which play ball 600 has made contact. Power display 412 may signal that a tug of tether 500 is not required prior to hitting next target through a red light and may indicate the force measured from force sensor 212 through a variable light intensity. Additionally, power display 412 may notify player 104 that it is time to select a game (flashes (2 HZ rate) while the Game Selections mode is active) and indicate that power ON condition.

An audio output subsystem may include MIDI, Speech, Mixer, Amplifier, Speakers, and Safety Limit Alarms subsystems. First speaker 406 and second speaker 408 each may provide audio output for MIDI files and speech files. All MIDI sounds, speech files, and related effects are indirectly controlled by the microprocessor's output.

D. Local I/O Bus 114

Local I/O bus 114 may be a set of conductors (wires or connectors in an integrated circuit) connecting game assembly 100 components to local input 110 and local output 112.

E. Power System 116

Game assembly 100 operations may require power to operate the onboard electronics. Power system 116 may provide power to game assembly 100. Power may be derived from an alternating current (AC) source 732, a battery 734, and power provided over Ethernet (POE) 736 (part of remote I/O system 120), each connected to power distribution and control 738.

In general, 115 AC power may be required for permanent installations from AC power source 732. The display LEDs and audio amplifier may operate directly on the 9-12 VDC source voltage, while microprocessor 106 and CMOS may operate down to 3 VDC. Moreover, it is estimate the related peak currents required will be between 200-260 mA of 9-12 VDC with an average of less than 80 mA. Thus, a wall wart (an AC to DC converter) may be included as part of power system 116 to reduce the longer wiring run to a safer, low level voltage of 9-12 VDC.

For installations that do not provide a nearby AC power source 732, game assembly 100 may be operated by battery 734. This may improve the portability of game assembly 100. Battery 734 may be charged from a 115 AC power source. Rechargeable lithium-ion batteries have high capacity and are light in weight. Thus, battery 734 preferably may be a rechargeable lithium-ion battery. Alternatively, lightweight nickel-cadmium batteries may be used.

Up to 300 mA of 48 VDC may be available from Power Over Ethernet (POE) 736—a present industry standard. Since the expected system power requirements for game assembly 100 may be below this level, game assembly 100 also may receive power over Ethernet 736. Ethernet 736 of remote I/O system 120 also may provide an ideal communications interface to upload and download game data directly to microprocessor 106 from a computer on the same network.

F. Remote I/O System 120

In addition to being a power source, remote I/O system 120 may provide communication and programming updates. To achieve this, remote I/O system 120 may include Ethernet 736, local Ethernet 740, external computer 742, and game assembly website 744. Ethernet interface with POE (Power Over Ethernet) 736 or a USB port may be utilized for communication with external Flash memory and may support the uploading of games and dialect specific data files. A communication interface may be compatible, where applicable, with new standards currently evolving for state-of-the-art appliances with similar interface data status and/or control functions interfacing with Ethernet hardware and software. Ethernet interface with POE also may be utilized with a Media Access Control (MAC) for unique identification on the network.

VII. Programming and Operations

Figure 18A:
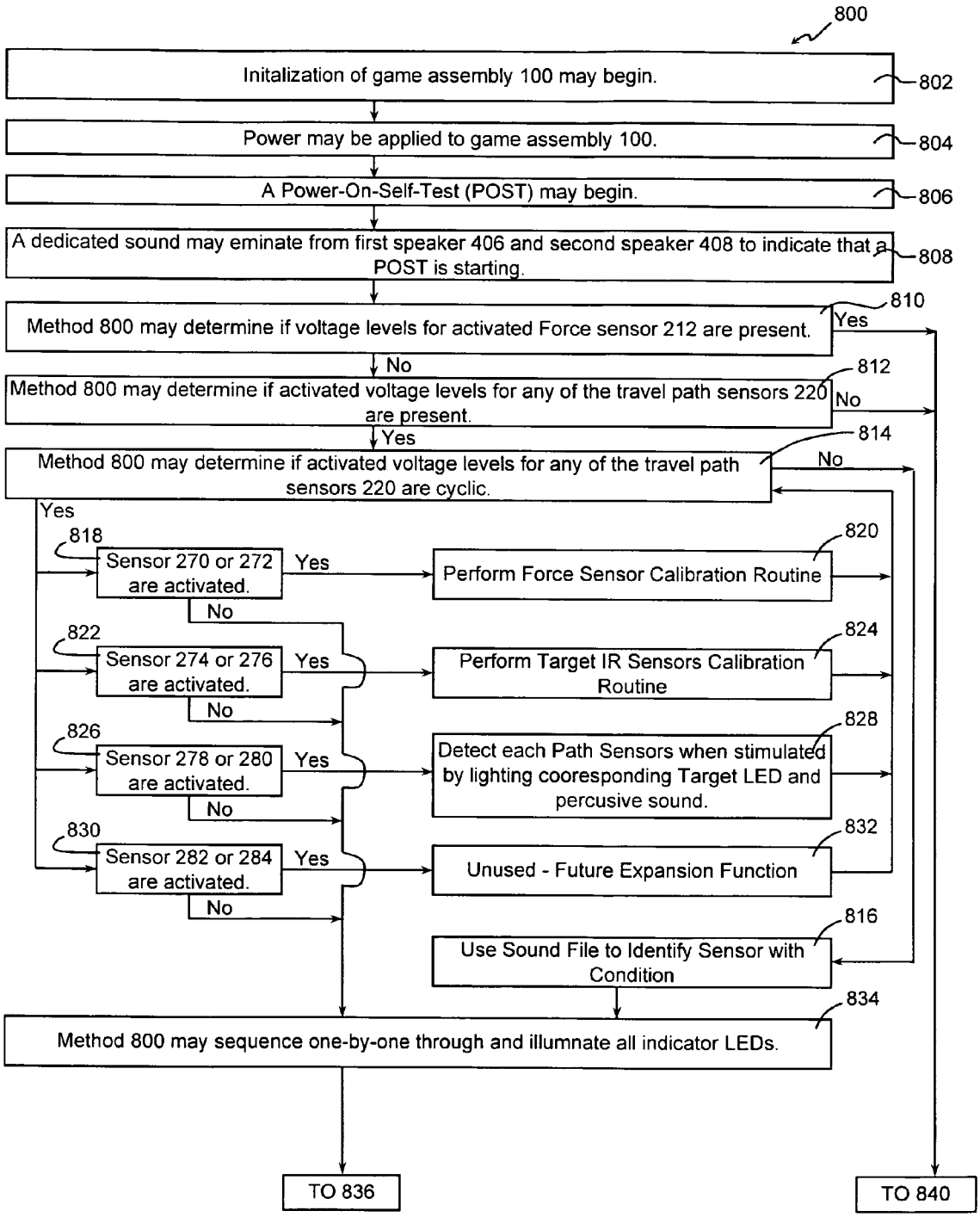
FIG. 18A illustrates a method 800 to operate game assembly 100.
Figure 18B:
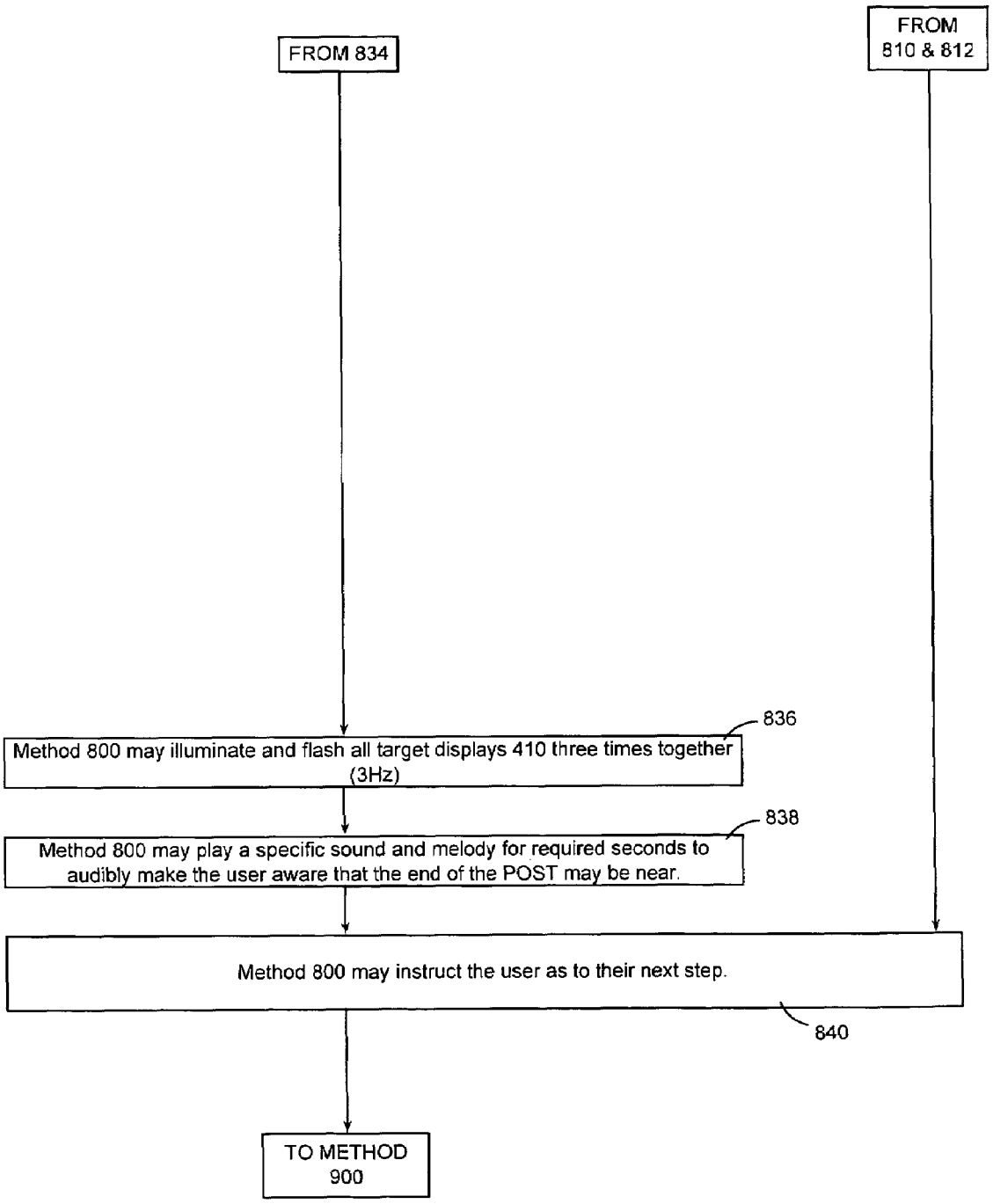
FIG. 18B illustrates a continuation of method 800 to operate game assembly 100.

FIG. 18A illustrates a method 800 to operate game assembly 100 and FIG. 18B illustrates a continuation of method 800 to operate game assembly 100. Game assembly 100 operations may include primary activities, initialization, game selection, and game playing. At 802, initialization of game assembly 100 may begin. At 804, power may be applied to game assembly 100. At 806, a Power-On-Self-Test (POST) may begin.

At 808, a dedicated sound may emanate from first speaker 406 and second speaker 408 to indicate that a POST is starting. In the overall operations of game assembly 100, normal voltage levels for non-activated levels are important because they may establish a baseline from which microprocessor 106 may make decisions. Accordingly, at 810, method 800 may determine if nominal voltage levels for non-activated levels are present. One way to make this determination may be to receive voltage signals in microprocessor 106 from each of the five sensors: force sensor 212, spin sensor 214, travel path sensor 220, play ball strike sensor 226, and target strike sensor 330.

If nominal non-activated voltage levels are present, method 800 may proceed to step 840. If nominal non-activated voltage levels for each of the five sensors are not present, method 800 may proceed to 812. At 812, method 800 may determine if activated voltage levels for any of the travel path sensors 220 are present. If activated voltage levels for any of the travel path sensors 220 are not present, method 800 may proceed to step 840. If activated voltage levels for any of the travel path sensors 220 are present, method 800 may proceed to step 814.

At 814, method 800 may determine if activated voltage levels for any of the travel path sensors 220 are cyclic. If none of the travel path sensors 220 are cyclic, then method 800 may proceed to 816, where method 800 may use a sound file to identify a sensor with a condition. From step 816, method 800 may proceed to step 834.

If one of the travel path sensors 220 are cyclic as determined at step 814, then method 800 may determine whether at least one of two adjacent sensors are activated. In the present example, there are eight sensors: 270, 272, 274, 276, 278, 280, 282, and 284. In other embodiments, there may be more than or less than eight sensors and there may be an odd number of sensors. From step 814, method 800 may proceed to each of step 818, 822, 826, and 830.

At step 818, method 800 determines whether at least one of sensor 270 and 272 are activated. If neither is activated, then method 800 may proceed to step 834. If at least one of one of sensor 270 and 272 is activated, then method 800 performs a force sensor calibration routine at step 820. From step 820, method 800 may return to step 814.

At step 822, method 800 determines whether at least one of sensor 274 and 276 are activated. If neither is activated, then method 800 may proceed to step 834. If at least one of one of sensor 274 and 276 is activated, then method 800 performs a target IR sensor calibration routine at step 824. From step 824, method 800 may return to step 814.

At step 826, method 800 determines whether at least one of sensor 278 and 280 are activated. If neither is activated, then method 800 may proceed to step 834. If at least one of one of sensor 278 and 280 is activated, then method 800 detects each path sensor when stimulated by lighting a corresponding target LED and emitting a percussive sound at step 828. From step 828, method 800 may return to step 814.

At step 830, method 800 determines whether at least one of sensor 282 and 284 are activated. If neither is activated, then method 800 may proceed to step 834. If at least one of one of sensor 282 and 284 is activated, then method 800 performs an unused future expansion function at step 832. From step 832, method 800 may return to step 814.

At 834, method 800 may sequence one-by-one through and illuminate all indicator LEDs. If one LED fails to light, this may convey to a user that the unlit LED may need to be replaced.

At 836, method 800 may illuminate and flash all target displays 410 three times together (3 HZ). This flashing may be use as a signature pattern to signal to player 104 "operation completed" and that any action by game assembly 100 that follows is a separate operation. At 838, method 800 may play a specific sound and melody for a few seconds to make the user aware audibly that the end of the Power-On-Self-Test (POST) may be near. At 840, method 800 may instruct the user as to their next step, such as by playing a speech file, "Game Assembly 100 Ready! . . . Tap direction detector 222 or tug on tether 500 to select a game, and then tug on tether 500 to confirm your game selection." Method 800 may then proceed to method 900—selecting and playing a game.

Figure 19A:
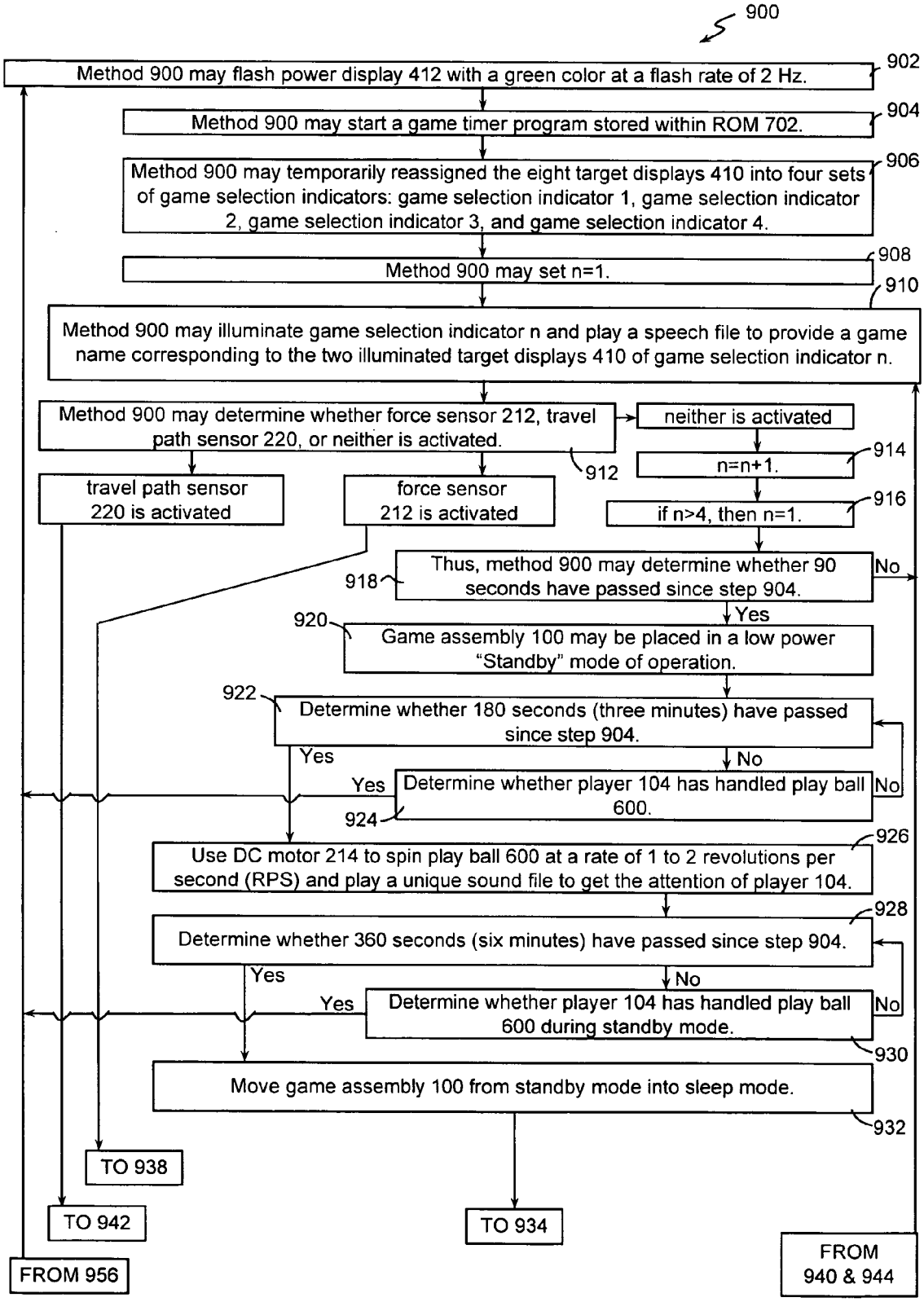
FIG. 19A illustrates method 900 to select and play a game.
Figure 19B:
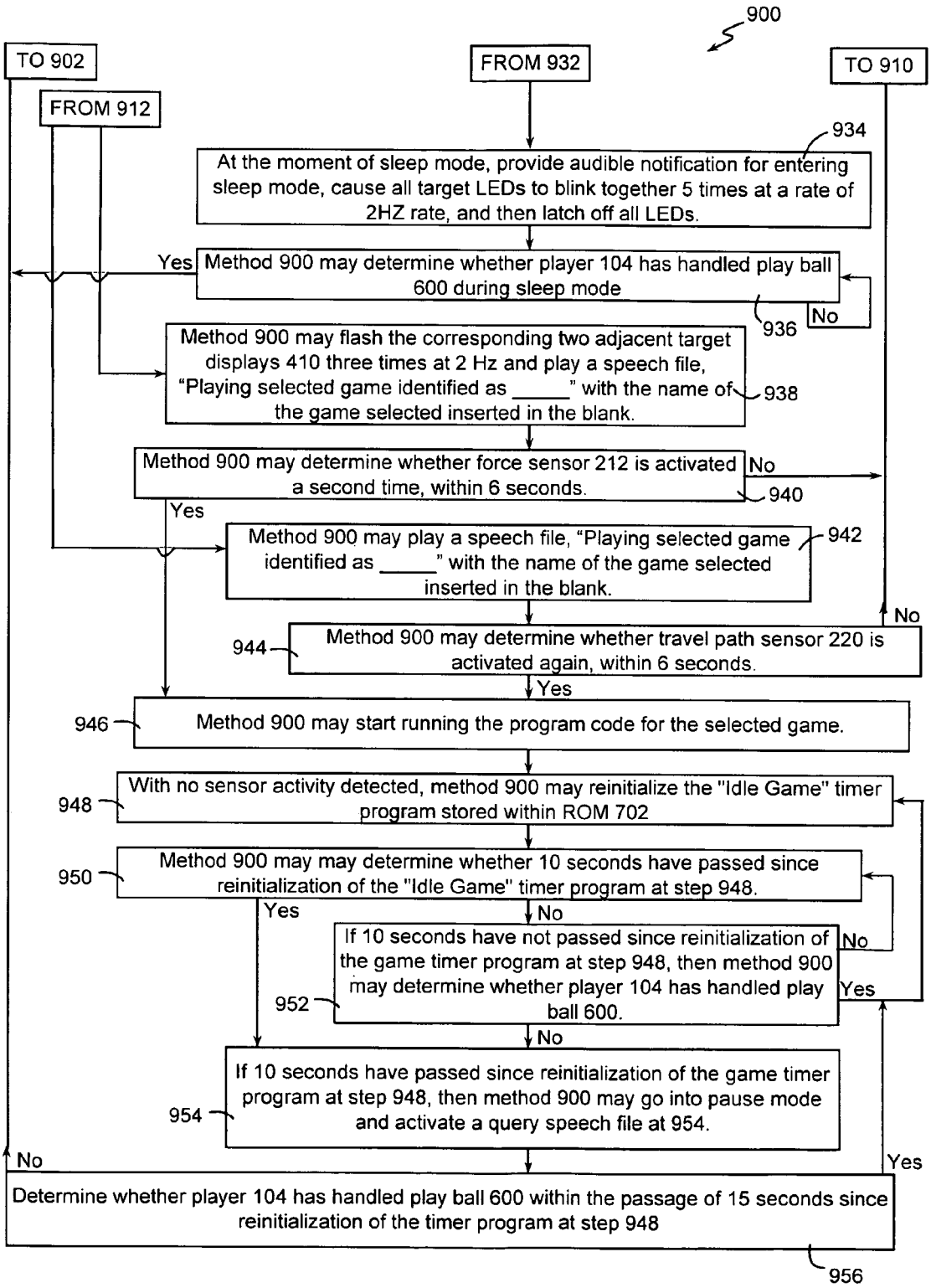
FIG. 19B illustrates a continuation of method 900 to select and play a game.

FIG. 19A illustrates method 900 to select and play a game and FIG. 19B illustrates a continuation of method 900 to select and play a game. Game selection in game assembly 100 is unique because there are no extra keys to press—the sensors used for target, direction, and force may be used to access and select from available game programs. At 902, method 900 may flash power display 412 with a green color at a flash rate of 2 Hz. This flashing may identify a "between game play status" and indicate that games may be available for selection by player 104. At 904, method 900 may start a game timer program stored within ROM 702.

In one embodiment, read only memory 702 may be preloaded with four game programs. Accordingly, two adjacent target displays 410 may be lit at a single time to identify a particular game program from the four game programs loaded within read only memory 702. At 906, while power display 412 is flashing green to indicate game selection mode, method 900 may temporarily reassigned the eight target displays 410 into four sets of game selection indicators: game selection indicator 1, game selection indicator 2, game selection indicator 3, and game selection indicator 4. At 908, method 900 may set n=1.

Incremental value "n" and other incremental step values may be assigned to cause predefined events to occur. The entire signal range may be divided by four in respect of the four preloaded game programs and resolution may be across the range provided by sensitivity adjustment 236. The entire signal range may be divided in other ways as well.

Game assembly 100 may provide access to four different games permanently stored within ROM 702. However, each game may provide more than an initial level of complexity. For example, the complexity of each game may progress as the players' performance improves. In general, the advanced or higher levels of game play may be attained after successfully going through the lower level game playing activities first.

Recall that force sensor 212 may be activated by player 104 tugging on tether 500 and that travel path sensor 220 may be activated by player 104 swinging tether 500 to cause clapper 224 to impact a direction detector 222. Both of these may be utilized by player 104 to select a particular game program.

At 910, method 900 may illuminate game selection indicator n and play a speech file to provide a game name corresponding to the two illuminated target displays 410 of game selection indicator n. At 912, method 900 may determine whether force sensor 212 is activated, travel path sensor 220 is activated, or neither is activated. If neither force sensor 212 nor travel path sensor 220 is activated within two seconds of illumination of game selection indicator n, for example, then method 900 may proceed to 914. At 914, n=n+1. At 916, if n>4, then n=1.

A low power "Standby" mode of operation automatically may be initiated by play ball 600 inactivity detected for 90 consecutive seconds. Thus, method 900 may determine at 918 whether 90 seconds have passed since step 904. If 90 seconds have not passed since step 904, method 900 may return to step 910. This 90-second value and other time timing events may be any value that provides a similar function behind the timing event.

If 90 seconds have passed since step 904, then game assembly 100 may be placed in a low power "Standby" mode of operation at step 920. In standby mode, no game is in progress. Here, input processing functions may be limited to only constant monitoring of signals from force sensor 212. In addition, periodically, indicators may be sequencing, chasing, and flashing patterns. Regular idle periods (no lights no sounds) lasting from 2-15 seconds each (for example, initially 2 seconds and then growing longer with each repeating idle event over the 180 second time period) may occur over the 180 seconds. If a tug is detected by force sensor 212 while in standby mode, the system may begin to run programmed functions in a firmware-designated point starting immediately past the Power-On-Self-Test (POST).

Inactivity for three minutes may generate warnings. Inactivity for six minutes may place game assembly 100 in sleep mode. Thus, at 922, method 900 may determine whether 180-seconds (three-minutes) have passed since step 904. If 180-seconds have not passed since step 904, method 900 may determine at 924 whether player 104 has handled play ball 600. Handling play ball 600 may be determined by microprocessor 106 detecting one or more of a slap against play ball 600 (play ball strike sensor 226), rotation of play ball 600 (spin sensor 214), a tug on tether 500 (force sensor 212), swinging of play ball 600 (travel path sensor 220), and play ball 600 hitting a target device 300 (target strike sensor 330).

If player 104 has not handled play ball 600 as determined at step 924, then method 900 may proceed from step 924 back to step 922. If player 104 has handled play ball 600, then method 900 may proceed from step 924 back to step 902.

Prior to entering low power "Sleep" mode, game assembly 100 may work to get the attention of player 104. Accordingly, if 180-seconds have passed since step 904, game assembly 100 at step 926 may use DC motor 214 to spin play ball 600 at a rate of 1 to 2 revolutions per second (RPS) and play a unique sound file to get the attention of player 104.

At 928, method 900 may determine whether 360-seconds (six minutes) have passed since step 904. If 360-seconds have not passed since step 904, method 900 may determine at 930 whether player 104 has handled play ball 600 during standby mode. If player 104 has not handled play ball 600 during standby mode, then method 900 may proceed from step 930 to 928. If player 104 has handled play ball 600 during standby, then method 900 may proceed from step 930 to 902.

If 360-seconds (six minutes) have passed since step 904, then method 900 may move game assembly 100 from standby mode into sleep mode at 932. In sleep mode, game assembly 100 may be in a very deep sleep where microprocessor 106 is a lowest power consumption mode and the signal from force sensor 212 may be monitored once every two seconds. All other devices may be powered off. When a signal from force sensor 212 is detected, microprocessor 106 may wake up the system and Power-On-Self-Test (POST) may begin.

At 934 at the moment of sleep mode, method 900 may provide audible notification for entering sleep mode, cause all target LEDs to blink together 5 times at a rate of 2 HZ rate, and then latch off all LEDs. This may be used as a signature pattern for "system sleep" and anything that follows may be understood to be a separate operation.

A signal on force sensor 212 may wake-up the system (striking play ball 600 may wake-up the system also). At 936, method 900 may determine whether player 104 has handled play ball 600 during sleep mode. If player 104 has not handled play ball 600 during sleep mode, method 900 may return to 936. If player 104 has handled play ball 600 during sleep mode, then method 900 may play a unique sound to signify the wake-up event and return to 902.

Recall that at 912, method 900 may determine whether force sensor 212 is activated, travel path sensor 220 is activated, or neither is activated. The above discussed a situation where neither force sensor 212 nor travel path sensor 220 was activated. Now, if force sensor 212 is activated, then this may mean that player 104 may have tugged on tether 500 with the desire to select the recently identified game. A second tug on tether 500 may confirm this selection.

If force sensor 212 is activated as determined at step 912, then method 900 may proceed to 938. At 938, method 900 may flash the corresponding two adjacent target displays 410 three times at 2 Hz and play a speech file, "Playing selected game identified as_____" with the name of the game selected inserted in the blank. At 940, method 900 may determine whether force sensor 212 is activated a second time. If force sensor 212 is activated again such as with a second tug on tether 500 within two seconds of the first tug, then method 900 may advance to step 946 and start running the program code for the selected game. If force sensor 212 is not activated again, then method 900 may return to 910.

As an alternative to tugging on tether 500, player 104 also may be able to select directly one of the four available games without waiting for the name of the game to be spoken. One way to achieve this is for player 104 to tap a travel path sensor 220. Tapping a travel path sensor 200 may be accomplished by hitting play ball 600 in a given direction. As discussed below, two good strikes at play ball 600 in the same direction may select a particular game.

Again, recall that at 912, method 900 may determine whether force sensor 212 is activated, travel path sensor 220 is activated, or neither is activated. If travel path sensor 220 is activated, then method 900 may proceed from 912 to 942. At 942, method 900 may play a speech file, "Playing selected game identified as_____" with the name of the game selected inserted in the blank. At 944, method 900 may determine whether travel path sensor 220 is activated again. If travel path sensor 220 is not activated again, then method 900 may return to 910. If travel path sensor 220 is activated again such as by clapper 224 impacting a direction detector 222 within two seconds of the activation of a travel path sensor 220, then method 900 may proceed to 946. At 946, method 900 may start running the program code for the selected game.

Method 900 now may proceed from 946 to 948. At 948, method 900 may reinitialize the game timer program stored within ROM 702. Once the program code for the selected game has begun at 946, the game may be considered "In Play" as long as play ball 600 is moving. As long as the game is In Play, the timer for the game may continue to count. If play ball 600 stops moving, method 900 may go into pause mode and eventually standby mode and then sleep mode.

At 950, method 900 may determine whether 10 seconds have passed since reinitialization of the game timer program at step 948. If 10 seconds have not passed since reinitialization of the game timer program at step 948, then method 900 may determine at 952 whether player 104 has handled play ball 600. If player 104 has not handled play ball 600, then method 900 may return to step 950. If player 104 has handled play ball 600, then method 900 may return to step 948 and reinitialize the game timer program.

If 10 seconds have passed since reinitialization of the game timer program at step 948, then the 10 seconds must have passed without player 104 handling play ball 600. Thus, method 900 may go into pause mode and activate a query speech file at 954. The query speech file at 954 may ask, "Would you like to continue this game? If YES, please begin playing otherwise this game may enter Standby mode." Method 900 additionally may assign a dedicated system sound to this event, such as a questioning sound.

At 956, method 900 may determine whether player 104 has handled play ball 600 within the passage of 15 seconds since reinitialization of the game timer program at step 948. If player 104 has handled play ball 600 within the passage of 15 seconds since reinitialization of the game timer program at step 948, then method 900 may return to 948. If player 104 has not handled play ball 600 within the passage of 15 seconds from step 954, then method 900 may return to 902 where player 104 may select a different game or take no action and let game assembly 100 eventually go into sleep mode. In other words, if no tug, target, or direction activity is detected for an additional 5 seconds after 952, then the game program may return to the default activity of game selection. Thus, to select a different game only requires the player to avoid handling play ball 600 for 15 seconds while a game is active.

FIG. 20A is a table summarizing game assembly 100 options and FIG. 20B is a continuation of the table of FIG. 20A summarizing game assembly 100 options.

VIII. Games

Game assembly 100 unit may provide several individual games where each game may test multiple skill levels. The game data may reside inside flash memory 704 of game assembly 100 and may be updated from selections available over the Internet at game assembly 100 website 744. Several games for game assembly 100 are described below. Some game based objectives may be designed to escalate in a linear fashion, over time, while others may provide specific game "Levels." Each game may conform to the storyboard in Table 1 below.

TABLE 1

| Story Board<br>STORY BOARD |
|---|
| Game Objects and Fundamentals: |
| Introduction |
| Player Game Selection Game Startup Cond. |
| (Signature Lights & Sounds) |
| Game Instructions |
| Object of the Game (game rules) |
| Initial challenge |
| Number of Players |
| Default |
| Max |
| Minimum Skill Level Required |
| Progressive challenge |

TABLE 1-continued

| Story Board<br>STORY BOARD |
|---|
| Number of Skill Levels |
| Quantized |
| Linear |
| Non-Linear |
| Game Skill Level Advancement |
| Quantized |
| Linear |
| Non-Linear |
| Transition indctrs & related symptms) |
| Nominal Game Outputs Operations |
| Game Lighting Operations |
| Game Music |
| Sound Effects |
| Event Driven Lights |
| Event Driven Sounds |
| Optional Sounds |
| Game Scoring |
| Music Beat Source & Sink |
| Detected Play Ball Activities: |
| Downward @ 45° Vertical |
| Forward @ 0° Vertical |
| Upward @ 45° Vertical |
| Down @ 90° Vertical |
| Direct @ Target (Times X) |
| Straight Ahead 0° Horz ± 22.5° |
| Behind 180° Horz ± 22.5° |
| Left 45° Horz ± 22.5° |
| Left 90° Horz ± 22.5° |
| Left 135° Horz ± 22.5° |
| Behind 180° Horz ± 22.5° |
| Right 45° Horz ± 22.5° |
| Right 90° Horz ± 22.5° |
| Right 135° Horz ± 22.5° |
| Detected Force Sensor Levels: |
| Blind zone window (4 preset levels) |
| Zone 1 |
| Zone 2 |
| Zone 3 |
| Zone 4 |
| total range = (Peak Level − Blind zone) |
| Zone = ((Peak Level − Blind zone)/3) |
| Spin Detection: |
| Clockwise |
| Spin Rate 1 |
| Spin Rate 2 |
| Spin Rate 3 |
| Spin Rate 4 |
| Counter-Clockwise |
| Spin Rate 1 |
| Spin Rate 2 |
| Spin Rate 3 |
| Spin Rate 4 |
| Target Detection: |
| Target 1 |
| Target 2 |
| Target 3 |
| Target 4 |
| Target 5 |
| Target 6 |
| Target 7 |
| Target 8 |
| Target 9 |
| Target 10 |
| Target 11 |
| Target 12 |
| Target 13 |
| Target 14 |
| Target 15 |
| Target 16 |
| Punch Detection: |
| Single |
| Repetition Rate |
| Points for timing |
| Points for target accuracy |
| Points for endurance |
| Reporting Game Scores |

TABLE 1-continued

| Story Board<br>STORY BOARD |
|---|
| Play Ball Signatures |
| Strike time before Tug |
| Strike time after Tug |
| Game Ending Condition |

Game 1: Target Based

This is a single player game with steady sequencing indicators as targets and dynamic sounds.

Object of the Game—Level 1:

Rhythmic sounds pound as the player attempts to place play ball 600 on an illuminated target, (lighting on the star tips) that change by the incremental sequencing at a 0.1 Hz rate with only each target LED CW sequence.

2. Autonomous Game Lights

Only one target is lit at-a-time as it sequentially enables each (1 of 8) target LEDs. It starts with a slow sequencing at a 0.01 Hz rate and increments the speed only after 3 consecutive targets have been acquired without missing any. Sound effects accompany the milestone achievements. A circle pattern is displayed by the sequencing of individual target LEDs (one-at-a-time) in a CW or CCW sequence. A speed change of proximately 4% shall be the baseline.

3. Event Driven Lighting

When an identified targets are hit in a timely manner a dynamic sound [ ] is heard and the related target indicator blinks 5 times @ 4 HZ. Progressively, but only at the highest level the target change rate can randomly speed up or slow down and change direction of orbit from a CW rotation to CCW and visa versa as player is consistently successful with play ball activities.

Game 2: Direction Based

This game may be either a single or a two-player game—as selected by the player.

Level 1: follows the opponent or system identified target striking pattern for direction sensors. TUG is not important other than when detected without target acquisition sensor detection. Scoring takes into account the number of attempts (TUGs) divided by the number of segments required, this provides a percentage score.

Level 2: "Advanced" version also requires the timing be equal to or better than the original source being copied. Both allow a player to play with another person or against game assembly 100. "Player one" and "Player two" are announced and the target light all flash together to signal the switch.

Game 3: Play Ball Strike Based

This game may be either a single or a two-player game—as selected by the player.

Striking play ball 600 with a number of consecutive hits without losing the players established pace. The game counts the consecutive number of play ball strikes (or individual force TUGs on low-end version). A single miss in the pace causes a funny error sound and strike counting starts from the beginning again. Alternately, the total number of strikes counted as missed divided by the total number of attempts may provide a percentage score. Game ends when 3 seconds have passed without detection of play ball activity.

Game 4: Strike and Target Based

This may be a single player game starting as a simple strike based game and with a minimum number of consistent strikes, starting with 10, then begins to introduce targets.

In this game all the LEDs light and the timer (and ticking sound) starts with a swish sound—when LED(s) are HIT while lit they turn off and if are hit again they turn off visa versa. In one phase of the game all target must be hit so when all indicator lights have turned OFF/ON a time score is collected at this point and reported. Then the opposite effect is the goal—this could be repeated XX with more timers or other targeting patterns such as every other target. But only once per TUG. Sound effects include Thud and Thumping as wrong targets are hit and bell sounds or explosions when the right targets are hit. Primary instrument sounds will be different each time around the star sensors.

Game 5: Direction Based with Variable Width

While target pairs of LEDs are lit, the player is required to hit the ball into that ZONE general direction spends more time in those areas between the lit pairs. This game progressively gets more difficult, but will allow the player to restart the game at the last successful level rather than lose all. If the player makes it to the end a special sound, LED pattern displayed and cheering is heard. Game starts with target LEDs lit on nearly opposite ends of the Sensor Head assembly, but at least one target less so the played can easily determine the required direction. Then as ten correct and consecutive hits are detected by the direction sensors, the next zone is indicated and may shift initially to a different direction, but not a different angle. The requirements repeat until after three direction changes the angle begins to become less and the requirements repeat again. This pattern continues until only two neighboring target LEDs are lit and the player has triggered all direction sensors in the order indicated. Switching of target selections shall happen while Play Ball position is at TUG peak, so the player has plenty of time to prepare for then next strike.

Game 6: (Strike, Direction and Target Based)

In this game, Children's songs may be used: Row, row, row your boat, Patty cake patty cake, Mary had a little lamb, Itsy bitsy spider, and other familiar nursery rhymes.

Midi sounds and effects may be generated with a unique sound effect or tone assigned to each direction sensor. Direction sensors initiate same sounds as the midi based rhythms played. The strike sound continues along with the midi melody and counter point with the existing melodies each individually maintaining their own time sounds. This continues until either all instruments have played the target song melody. When completed the cheers and score are heard. This starts with only a simple melody using the same midi sound as what will be used in the song that follows. Level 1—Several target LEDs are lit, at a time, as the player tries to get play ball 600 to avoid hitting the identified targets, but still make regular contact with a direction sensor.

Game 7: TUG Force Based

Starting with a background audio hum slowly varying in amplitude and phase, as play ball 600 is idle (no TUG and no direction or target signals. As TUG is detected, a slow midi rhythm plays with only a single instrument then if a steady pattern of TUG peaks are detected along with the existing sounds enabled. This continues until either all instruments play the target song or until the rhythm pattern is broken and less instruments are playing. If the song playing is completed a special sound effect with cheering is heard. In the end, percentage scoring is provided for this game, the goal is to complete the song. Other variations could include saying the alphabet, counting to 100, or saying a familiar nursery rhyme.

Game 8: TUG Rhythm Based

Midi music beat is affected by steady strike pattern frequency. Thus, the player controls the steady beat of the music, based on the moving average of the last 3 TUG signals. Midi rhythm a single instrument then, if a steady pattern of TUG peaks is detected, another instrument begins to play in its own related melody along with the existing sounds enabled. This continues either until all instruments play the target song or if the rhythm pattern is broken less instruments. This starts with only a simple melody using the same midi sound as what will be used in the song that follows. At play ball 600's peak travel extension "TUG signal" the beat is established and maintained.

IX. Additional Information

The physical aspects of game assembly 100 may be simply described as a light vinyl ball tethered by an elastic cord to an overhead fixture containing an array of various sensors and electronics for detecting the ball's movements and for intelligently interacting with the player. Since the player interacts with a lightweight moving object (play ball 600), game assembly 100 provides a viable alternative to more physically strenuous sporting activities. In particular, game assembly 100 allows a person to pursue physical and mental exercise with substantially lower physical stress than what is provided by most traditional methods.

Since game assembly 100 incorporates new modular concepts of hardware and software functionality, a broad range of applications and unique venues may be easily supported. Unique games are provided utilizing various sensors with audible coaching and feedback operations. Game assembly 100 responses may be customized for a wide range of applications beyond simply playing a game for the fun of it. Playing by specific game guided rules and keeping score, easily augments custom physical therapy regimes by detailed collection of related performance data. As required, metrics collected by game assembly 100 system may be uploaded to a host computer and saved for personal performance history logs with substantial database potential for commercial use.

The outer surface of play ball 600 itself provides for great exposure in a highly visibility area to place a graphic or message as needed and accordingly can easily play a significant role in the promotional advertising or marketing of any product.

All game interactions may be customized for language, sound, and music making game assembly 100 system a powerful and highly flexible device with worldwide potential.

Two or more game assemblies 100 may be synchronized to work together for team-oriented activities and accordingly play together in group based competition such as by using the Internet. In a low lit room or even in the dark this is something to see; the game play is quite enhanced by sequencing of target LEDs and makes the game more intuitive. Another embodiment may use many targets, including some positioned on walls of a room and make use of multiple play balls, where some play balls may be untethered and others tethered.

Multiple players may be accommodated on a single game assembly 100 to compete directly against each other in selected games. The divisions may be combinations or groups of two or four adjacent direction sensors comprising a player zone to be protected. Multiplayer operation may have a player protect their zones by either preventing play ball 600 from extending completely to generate a force signal from the other player or from traveling in a direction enough to be detected by the Direction sensors on the defensive side. The offensive side may be trying to place play ball 600 all the way inside the opponents' zone to trigger a direction sensor in their zone only.

Due to the modular architecture of game assembly 100 gaming system design, several embodiments are available. For example, a simplest version of a game assembly 100 may utilize only a single sensor, such as force sensor 212. In addition, the sounds produced, as responses to play ball 600's dynamics, may be directly generated by only microprocessor 106 as Pulse Width Modulation. This extremely economical version may establish a bottom level product baseline. This simplest product baseline, without targets or scoring may be an ideal as a standalone product for younger children.

A next level up from game assembly 100 baseline may include several enhancements. The simple addition of speech, music, targets and direction detection, to name a few, may make the game assembly 100 useable for a much broader range of applications. Since a player need not chance play ball 600 and can hear play ball 600 and the targets, wheel chair bound individuals and those who are blind can play games from game assembly 100.

Game assembly 100 may be scaled to fit above the crib of a baby. Here, game assembly 100 may play different songs or prerecorded voice messages from parents in response to a baby's interaction with play ball 600. The volume of the emanating sound may be adjusted in feedback from the baby's interaction with an embodiment. Here, the baby may control their universe through game feedback as guided by parental selections made during programming.

The exemplary embodiments described herein are provided merely to illustrate the principles disclosed and may not be construed as limiting the scope of the subject matter of the terms of the claims. The specification and drawings are, accordingly, to be regarded in an illustrative rather than a restrictive sense. Moreover, the principles disclosed may be applied to achieve the advantages described herein and to achieve other advantages or to satisfy other objectives, as well. The description has made reference to specific exemplary embodiments thereof. It will, however, be evident that various modifications and changes may be made thereto without departing from the broader spirit and scope as set forth in the appended claims. The specification and drawings are, accordingly, to be regarded in an illustrative sense rather than a restrictive sense.

What is claimed is:

1. A tethered ball game, comprising:

a play ball;

a sensor head assembly remote from the play ball having a force sensor to determine an impact power imparted to the play ball, a spin sensor to determine a rotational value of the play ball, a travel path sensor to determine a path of travel of the play ball, and a play ball strike sensor to determine a strike to the play ball;

a tether adapted to be connected between the play ball and the sensor head assembly;

a target device;

a player feedback system having at least one of light feedback and electrically generated audio feedback; and a controls system, where the spin sensor includes a motor both to impart spin into the play ball and to determine a rotational value of the play ball, where the rotational value of the play ball is considered valid and not a false triggering signal when the motor generates no less than 20 millivolts for a duration of more than 160 milliseconds, and where a game control is configured to be connected through a network to download into the control system new and customized game configurations and to upload player game statistics, where the game control includes a wireless gaming network interface.

2. The tethered ball game of claim 1, where the force sensor includes a plate made of permanently polarized material and where the spin sensor is connected between the plate and the tether.

3. The tethered ball game of claim 1, where the play ball is configured to impart force onto the force sensor and where the force sensor includes a sensitivity adjustment to automatically adjust a width of a blind zone window, where a waveform signal residing in the blind zone window defines no force being imparted by the play ball onto the force sensor and where a waveform signal residing outside the blind zone window defines a force being imparted by the play ball onto the force sensor.

4. The tethered ball game of claim 3, where an upper boundary of the blind zone window is configured to be adjusted higher in bipolar millivolt level through the sensitivity adjustment and where a lower boundary of the blind zone window is restricted from being adjusted below a ambient driven millivolt level.

5. The tethered ball game of claim 3, where the force sensor is configured to translate successive striking of the play ball into a player beats-per-minute (PBPM) count.

6. The tethered ball game of claim 1, where the rotational value of the play ball includes both a rotational spinning value and a spinning direction value.

7. The tethered ball game of claim 1, where a coupler is disposed between the spin sensor and the tether and where the coupler is held in place through compression force imparted by the coupler.

8. The tethered ball game of claim 1 where the force sensor, the spin sensor, the travel path sensor, and the play ball strike sensor are configured to operate and detect play ball activities without making direct contact with the play ball.

9. The tethered ball game of claim 1, where imparted spin into the play ball is accompanied by a sound effect.

10. The tethered ball game of claim 1, where a gaming experience is configured to be customized by a game user by the game user selecting personal options available in a modular nature of a game topology.

11. The tethered ball game of claim 1, where the spin sensor includes an optical strobe disk and an infrared sensor.

12. The tethered ball game of claim 1, where the travel path sensor includes a direction detector attached to an interior of a cone, where the cone is attached to the force sensor, and where the travel path sensor further includes a clapper attached between the force sensor and the tether, where the travel path sensor is configured to determine a radial movement of the play ball within 11.25 degrees.

13. The tethered ball game of claim 1, where the play ball strike sensor includes a microphone and a hardware circuit, where the hardware circuit is configured to confirm a strike to the play ball on receiving a 200 Hz audio frequency input lasting less than 200 mS and at least 5 dB above an ambient room level.

14. The tethered ball game of claim 1, where the target device includes a target that is removably attached to the target device.

15. The tethered ball game of claim 1, where the target device includes a proximity sensor having an emitter light pipe with a light emitting end opening and a detector light pipe with a light receiving end opening, where at least one of the light emitting end opening and the light receiving end opening are arranged to face in the same direction as downward moving environmental light.

16. The tethered ball game of claim 1, where the tether and play ball are selected such that a time required for the play ball to fully extend the tether from a time in which the play ball is struck is approximately the same time as the time required for the tether to sling the play ball to a target of the target device.

* * * * *